US010438604B2

(12) United States Patent
Petkov et al.

(10) Patent No.: US 10,438,604 B2
(45) Date of Patent: Oct. 8, 2019

(54) SPEECH PROCESSING SYSTEM AND SPEECH PROCESSING METHOD

(71) Applicant: KABUSHIKI KAISHA TOSHIBA, Tokyo (JP)

(72) Inventors: Petko Petkov, Cambridge (GB); Ioannis Stylianou, Cambridge (GB)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 156 days.

(21) Appl. No.: 15/446,828

(22) Filed: Mar. 1, 2017

(65) Prior Publication Data

US 2017/0287498 A1 Oct. 5, 2017

(30) Foreign Application Priority Data

Apr. 4, 2016 (GB) ..... 1605750.7

(51) Int. Cl.
*G10L 21/02* (2013.01)
*G10L 21/0208* (2013.01)
(Continued)

(52) U.S. Cl.
CPC ..... *G10L 21/0205* (2013.01); *G10L 21/0208* (2013.01); *G10L 25/06* (2013.01); *G10L 25/21* (2013.01); *G10L 2021/02082* (2013.01)

(58) Field of Classification Search
USPC ..... 704/200, 205, 206
See application file for complete search history.

(56) References Cited

U.S. PATENT DOCUMENTS 9,414,157 B2 * 8/2016 Lou ..... G10L 21/02
2008/0059157 A1 3/2008 Fukuda et al.
(Continued)

OTHER PUBLICATIONS

Search Report dated Aug. 31, 2016 in United Kingdom Patent Application No. GB 1605750.7.
(Continued)

*Primary Examiner* — Leonard Saint Cyr
(74) *Attorney, Agent, or Firm* — Oblon, McClelland, Maier & Neustadt, L.L.P.

(57) ABSTRACT

A speech intelligibility enhancing system for enhancing speech, the system comprising:

a speech input for receiving speech to be enhanced;

an enhanced speech output to output the enhanced speech; and a processor configured to convert speech received from the speech input to enhanced speech to be output by the enhanced speech output, the processor being configured to:

i) extract a frame of the speech received from the speech input;

ii) calculate a measure of the frame importance;

iii) estimate a contribution due to late reverberation to the frame power of the speech when reverbed;

iv) calculate a prescribed frame power, the prescribed frame power being a function of the power of the extracted frame, the measure of the frame importance and the contribution due to late reverberation, the function being configured to decrease the ratio of the prescribed frame power to the power of the extracted frame as the contribution due to late reverberation increases above a critical value, $\tilde{l}$; and v) apply a modification to the frame of the speech received from the speech input producing a modified frame power, wherein the modification is calculated using the prescribed frame power.

20 Claims, 12 Drawing Sheets
(4 of 12 Drawing Sheet(s) Filed in Color)

(51) Int. Cl.
*G10L 25/06* (2013.01)
*G10L 25/21* (2013.01)

(56) References Cited

U.S. PATENT DOCUMENTS

2015/0043742 A1* 2/2015 Jensen ..... H04R 25/554 381/66
2015/0124987 A1 5/2015 Hazrati et al.
2016/0210976 A1* 7/2016 Lopez ..... G10L 21/02

OTHER PUBLICATIONS

Takayuki Arai, "Padding zero into steady-state portions of speech as a preprocess for improving intelligibility in reverberant environments" Acoust. Sci. & Tech., vol. 26, No. 5, 2005, pp. 459-461.
Takayuki Arai, et al., "Using Steady-State Suppression to Improve Speech Intelligibility in Reverberant Environments for Elderly Listeners" IEEE Transactions on Audio, Speech and Language Processing, vol. 18, No. 7, Sep. 2010, pp. 1775-1780.
João B. Crespo, et al., "Speech Reinforcement in Noisy Reverberant Environments Using a Perceptual Distortion Measure" IEEE International Conference on Acoustic, Speech and Signal Processing (ICASSP), 2014, pp. 910-914.
João B. Crespo, et al., "Speech Reinforcement with a Globally Optimized Perceptual Distortion Measure for Noisy Reverberant Channels" 14th International Workshop on Acoustic Signal Enhancement (IWAENC), 2014, pp. 89-93.
Richard C. Hendriks, et al., "Speech Reinforcement in Noisy Reverberant Conditions under an Approximation of the Short-Time SII" IEEE, ICASSP, 2015, pp. 4400-4404.
Richard C. Hendriks, et al., "Optimal Near-End Speech Intelligibility Improvement Incorporating Additive Noise and Late Reverberation Under an Approximation of the Short-Time SII" IEEE/ACM Transactions on Audio, Speech, and Language Processing, vol. 23, No. 5, May 2015, pp. 851-862.
Nao Hodoshima, et al., "Improving syllable identification by a preprocessing method reducing overlap-masking in reverberant environments" J. Acoust. Soc. Am., vol. 119, No. 6, Jun. 2006, pp. 4055-4064.
Yuki Nakata, et al., "The Effects of Speech-Rate Slowing for Improving Speech Intelligibility in Reverberant Environments" IEICE Technical Report, Mar. 2006, pp. 21-24.
Petko N. Petkov, et al., "Spectral Dynamics Recovery for Enhanced Speech Intelligibility in Noise" IEEE/ACM Transactions on Audio, Speech, and Language Processing, vol. 23, No. 2, Feb. 2015, pp. 327-338.
Henning Schepker, et al., "Model-based integration of reverberation for noise-adaptive near-end listening enhancement" Interspeech, ISCA, Sep. 6-10, 2015, pp. 75-79.
Kim Silverman, et al., "Tobi: A Standard for Labeling English Prosody" ISCA Archive, ICSLP 92, Oct. 12-16, 1992, pp. 867-870.
Misaki Tsuji, et al., "Preprocessing using consonant emphasis and vowel suppression for improving speech intelligibility in reverberant environments" Acoustical Science and Technology, Technical Report, vol. 69, No. 4, 2013, pp. 179-183 (with English language translation).

* cited by examiner

SPEECH PROCESSING SYSTEM AND SPEECH PROCESSING METHOD

FIELD

Embodiments described herein relate generally to speech processing systems and speech processing methods.

BACKGROUND

Reverberation is a process under which acoustic signals generated in the past reflect off objects in the environment and are observed simultaneously with acoustic signals generated at a later point in time. It is often necessary to understand speech in reverberant environments such as train stations and stadiums, large factories, concert and lecture halls.

It is possible to enhance a speech signal such that it is more intelligible in such environments.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

Systems and methods in accordance with non-limiting embodiments will now be described with reference to the accompanying figures in which.

DETAILED DESCRIPTION

Figure 1:
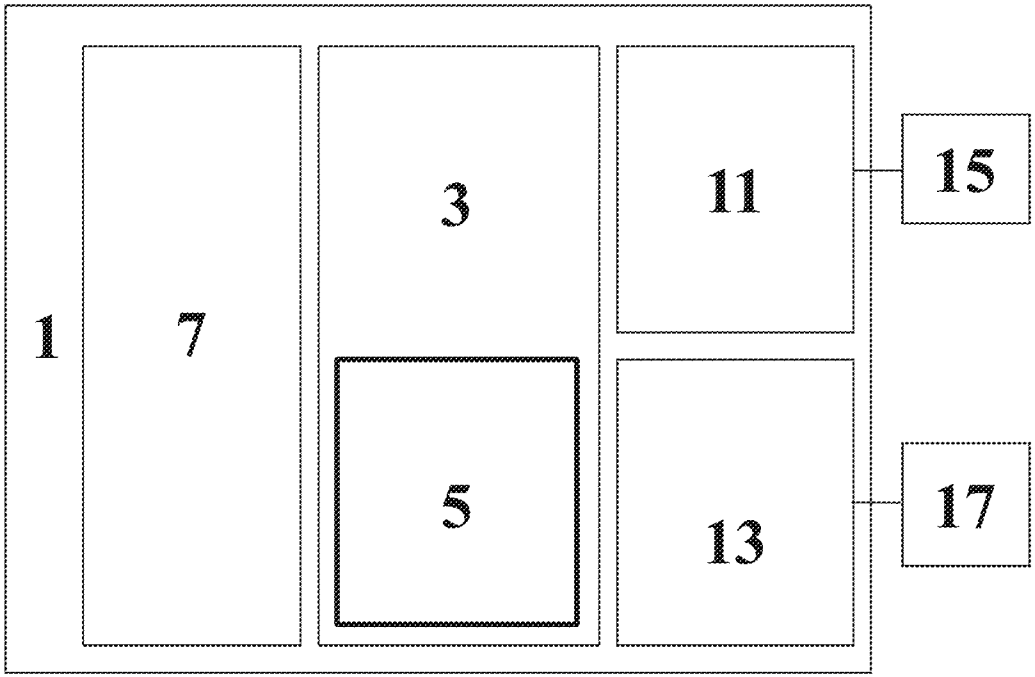
FIG. 1 is a schematic of a speech intelligibility enhancing system 1 in accordance with an embodiment.

According to one embodiment, there is provided a speech intelligibility enhancing system for enhancing speech, the system comprising:

a speech input for receiving speech to be enhanced;

an enhanced speech output to output the enhanced speech; and a processor configured to convert speech received from the speech input to enhanced speech to be output by the enhanced speech output, the processor being configured to:

i) extract a frame of the speech received from the speech input;

ii) calculate a measure of the frame importance;

iii) estimate a contribution due to late reverberation to the frame power of the speech when reverbed;

iv) calculate a prescribed frame power, the prescribed frame power being a function of the power of the extracted frame, the measure of the frame importance and the contribution due to late reverberation, the function being configured to decrease the ratio of the prescribed frame power to the power of the extracted frame as the contribution due to late reverberation increases above a critical value, $\tilde{l}$; and v) apply a modification to the frame of the speech received from the speech input producing a modified frame power, wherein the modification is calculated using the prescribed frame power.

According to another embodiment, there is provided a speech intelligibility enhancing system for enhancing speech, the system comprising:

a speech input for receiving speech to be enhanced;

an enhanced speech output to output the enhanced speech; and a processor configured to convert speech received from the speech input to enhanced speech to be output by the enhanced speech output, the processor being configured to:

i) extract a frame of the speech received from the speech input;

ii) calculate a measure of the frame importance;

iii) estimate a contribution due to late reverberation to the frame power of the speech when reverbed, l;

iv) calculate a prescribed frame power that minimizes a distortion measure subject to a penalty term, T, wherein T is a function of (a) the contribution l due to late reverberation, (b) the ratio of the prescribed frame power to the power of the extracted frame, and (c) a multiplier λ, wherein the function is a non-linear function of l configured to increase with l faster than the distortion measure above a critical value $\tilde{l}$; and v) apply a modification to the frame of the speech received from the speech input producing a modified frame power, wherein the modification is calculated using the prescribed frame power.

In an embodiment, the modification is applied to the frame of the speech received from the speech input by modifying the signal spectrum such that the frame of speech has a modified frame power.

In an embodiment, the prescribed frame power for each frame of inputted speech is calculated from the input frame power, the frame importance and the level of reverberation.

In an embodiment, the penalty term is:

$$T \propto \lambda l^{w} \frac{y}{x}$$

where w is greater than 1, y is the prescribed frame power and x is the frame power of the extracted frame. In an embodiment, w=2.

In an embodiment, the prescribed frame power is calculated subject to λ being a function of l.

In an embodiment, the prescribed frame power is calculated subject to λ being a function of the measure of the frame importance. The term λ is parametrized such that it has a dependence on the frame importance.

The frame importance is a measure of the similarity between the current extracted frame and one or more previous extracted frames. In an embodiment, the measure of the frame importance is a measure of the dissimilarity of the mel cepstrum of the extracted frame to that of the previous extracted frame.

In an embodiment, the contribution due to late reverberation is estimated by modelling the impulse response of the environment as a pulse train that is amplitude-modulated with a decaying function. The convolution of the section of this impulse response from time $t_l$ onwards and a section of the previously modified speech signal gives a model late reverberation signal frame. The contribution due to late reverberation to the frame power of the speech when reverbed is the power of the model late reverberation signal frame.

In an embodiment, the prescribed frame power is calculated from:

$$y = c_1 x + c_2 x^b + \frac{l}{2b}(l^{w-1}\lambda - 2b)$$

where y is the prescribed frame power, x is the frame power of the extracted frame, l is the contribution due to late reverberation, w is greater than 1, $c_1$ and $c_2$ are determined from a first and second boundary condition and b is a constant.

In an embodiment, the first boundary condition is:

$$y(\alpha)=\alpha$$

where a is the minimum value of the frame power obtained from sample speech data and wherein the second boundary condition is:

$$y'(\psi)=\varsigma^{l}$$

where $\varsigma \in (0,1)$ and $\psi >> \beta$, where β is the maximum value of the frame power obtained from sample speech data.

In an embodiment, the term λ is parametrized such that it has a dependence on the frame importance, and such that the crossing point of the prescribed frame power as a function of x and the function y=x is limited by β, where β is the maximum value of the frame power obtained from sample speech data and is the value of the crossing point at $l=\tilde{l}$. Furthermore, λ is parametrized such that the value of the crossing point for values of l below the critical value does not depend on the value of l and depends on the frame importance, and the value of the crossing point for values of l above the critical value does not depend on the value of l and depends on the frame importance.

In an embodiment, λ is calculated from:

$$\lambda=\max(\lambda_1,\tilde{\lambda}) \quad l\leq\tilde{l}$$

$$\lambda=\lambda_2 \quad l>\tilde{l}$$

wherein $\tilde{\lambda}$ is a constant determined such that the crossing point of the prescribed frame power as a function of x and the function y=x for $l=\tilde{l}$ and $\lambda=\tilde{\lambda}$ is β, and such that this is the maximum value of the crossing point for all values of l, and $\lambda_1$ and $\lambda_2$ are calculated as a function of the frame importance.

$\lambda_1$ and $\lambda_2$ are calculated such that the crossing point of the prescribed frame power as a function of x and the function y=x for all values of l is a value calculated as a function of the frame importance.

In an embodiment, the multiplier λ is calculated from:

$$\lambda=\max(\lambda_{v_\xi},\tilde{\lambda}) \text{ for } l\leq\tilde{l}$$

$$\lambda=\lambda_{\bar{v}} \text{ for } l>\tilde{l}$$

where $\tilde{\lambda}$ corresponds to an upper bound for the prescribed frame power $y(x=\beta, l=\tilde{l}, \lambda=\tilde{\lambda})=\beta$, wherein $\tilde{\lambda}$ is given by:

$$\tilde{\lambda} = \frac{b}{2(1-\varsigma^{l})}\frac{\beta^b - \alpha^b - (\beta-\alpha)b\psi^{b-1}}{\alpha^b\beta - \alpha\beta^b}$$

$\lambda_{v_\xi}$ is the value of λ corresponding to a prescribed frame power $y(x=v_\xi,l,\lambda=\lambda_{v_\xi})=v_\xi$, wherein $\lambda_{v_\xi}$ is calculated from:

$$\lambda_{v_\xi} = \frac{2b}{l^2}\frac{(\varsigma^{l}-1)(\alpha^b v_\xi - \alpha v_\xi^b)}{v_\xi^b - \alpha^b - b(v_\xi-\alpha)\psi^{b-1}} + \frac{2b}{l}$$

where $$\log(v_\xi) = \frac{1-e^{-s\xi}}{1+e^{-s\xi}}\{\log(\beta)+\log(\alpha)\} + \log(\alpha)$$

$\lambda\bar{v}$ is the value of λ corresponding to a prescribed frame power $y(x=\bar{v},l,\lambda=\lambda_{\bar{v}})=\bar{v}$, wherein $\lambda_{\bar{v}}$ is calculated from:

$$\lambda_{\bar{v}} = \frac{2b}{l^2}\frac{(\varsigma^{l}-1)(\alpha^b\bar{v} - \alpha\bar{v}^b)}{\bar{v}^b - \alpha^b - b(\bar{v}-\alpha)\psi^{b-1}} + \frac{2b}{l}$$

where $$\log(\bar{v}) = \frac{1-e^{-s\frac{\lambda_{v_\xi}}{\tilde{\lambda}}}}{1+e^{-s\frac{\lambda_{v_\xi}}{\tilde{\lambda}}}}\{\log(v_\xi)-\log(\alpha)\} + \log(\alpha)$$

where s is a constant, ξ is the frame importance and the value of $\tilde{l}$ is calculated from $$\frac{b}{\tilde{\lambda}}.$$

In an embodiment, step iii) comprises:

(a) calculating the fraction of the extracted frame power in each of two or more frequency bands;

(b) determining the frequency bands of the extracted frame corresponding to the highest power bands corresponding to a predetermined fraction of the extracted frame power;

(c) generating an approximation to the late reverberation signal;

(d) calculating the fraction of the power of the late reverberation signal in each of the frequency bands determined in (b);

wherein the contribution due to late reverberation to the frame power of the speech when reverbed is estimated as the sum of the powers of the late reverberation signal in each of the frequency bands calculated in (d).

The signal gain applied to the frame may be the prescribed signal gain $g_i$, where $$g_i^2 = \frac{y_i}{x_i}.$$

Alternatively, prescribed signal gain may be smoothed before it is applied, such that the applied signal gain $\ddot{g}_l$ is a smoothed gain.

In an embodiment, the rate of change of the modification is limited such that:

$$D < \ddot{g}_l \leq U^{\frac{\phi}{\sqrt{g_i}}}$$

where i is the frame index, $\ddot{g}_l$ is the smoothed signal gain, i.e. the square root of the ratio of the modified frame power to the power of the extracted frame, $g_i$ is the square root of the ratio of the prescribed frame power to the power of the extracted frame, and $\phi$, U and D are constants.

In an embodiment, the modification applied to the frame of the speech received from the speech input is calculated from:

$$\ddot{g}_l = \min(u_i, g_i) \text{ if } g_i > 1$$

$$\ddot{g}_l = \max(d_i, g_i) \text{ if } g_i \leq 1$$

where:

$$u_i = \frac{1 - e^{-s\xi_i}}{1 + e^{-s\xi_i}}\left(U^{\frac{\phi}{\sqrt{g_i}}} - 1\right) + 1$$

$$d_i = \frac{1 - e^{-s\xi_i}}{1 + e^{-s\xi_i}}(1 - D) + D$$

where s is a constant, $\phi$ is a constant, and $\xi$ is the frame importance.

The value of $\phi$ for a frame may be selected from two or more values, based on some characteristic of the frame. The value of s may be different for the calculation of u and d.

Step i) may comprise:

extracting overlapping frames of the speech received from the speech input;

and wherein the processor is further configured to:

vi) apply a local time scale modification if the ratio of the modified frame power to the power of the extracted frame is less than 1 and l is greater than $\tilde{l}$, wherein $\tilde{l}$ is the critical value of the contribution due to late reverberation.

Step vi) may comprise:

overlap adding the modified frame output from step v) to the modified speech signal comprising the modified previous frames, to output a new modified speech signal; and wherein applying a time scale modification comprises:

calculating the correlation between a last segment of the new modified speech signal and each of a plurality of target segments of the new modified speech signal, wherein the target segments correspond to a range of earlier segments of the new modified speech signal;

determining the target segment corresponding to the highest correlation value;

if the correlation value of the target segment is greater than a threshold value:

replicating the section of the new modified speech signal from the target segment to the end of the new modified speech signal;

overlap-adding this replicated section to the last segment of the new modified speech signal.

In an embodiment, the threshold value is the correlation value where the target segment is the last segment, multiplied by $\Omega$, where $\Omega \epsilon (0,1)$.

According to another embodiment, there is provided a method of enhancing speech, the method comprising the steps of:

receiving speech to be enhanced;

extracting a frame of the received speech;

calculating a measure of the frame importance;

estimating a contribution due to late reverberation to the frame power of the speech when reverbed;

calculating a prescribed frame power, the prescribed frame power being a function of the power of the extracted frame, the measure of the frame importance and the contribution due to late reverberation, the function being configured to decrease the ratio of the prescribed frame power to the power of the extracted frame as the contribution to late reverberation increases above a critical value, $\tilde{l}$; and applying a modification to the frame of the speech received from the speech input producing a modified frame power, wherein the modification is calculated using the prescribed frame power.

According to another embodiment, there is provided a carrier medium comprising computer readable code configured to cause a computer to perform the method of enhancing speech.

FIG. 1 is a schematic of a speech intelligibility enhancing system 1 in accordance with an embodiment.

The system 1 comprises a processor 3 comprising a program 5 which takes input speech and enhances the speech to increase its intelligibility. The storage 7 stores data that is used by the program 5. Details of the stored data will be described later.

The system 1 further comprises an input module 11 and an output module 13. The input module 11 is connected to an input 15 for data relating to the speech to be enhanced. The input 15 may be an interface that allows a user to directly input data. Alternatively, the input may be a receiver for receiving data from an external storage medium or a network. The input 15 may receive data from a microphone for example.

Connected to the output module 13 is audio output 17. The audio output 17 may be a speaker for example.

In use, the system 1 receives data through data input 15. The program 5, executed on processor 3, enhances the inputted speech in the manner which will be described with reference to FIGS. 2 to 12.

The system is configured to increase the intelligibility of speech under reverberation. The system modifies plain speech such that it has higher intelligibility in reverberant conditions.

In the presence of reverberation, multiple, delayed and attenuated copies of an acoustic signal are observed simultaneously. The phenomenon is more expressed in enclosed environments where the contained acoustic energy affects auditory perception until propagation attenuation and absorption in reflecting surfaces render the delayed signal copies inaudible. Similar to additive noise, high reverberation levels degrade intelligibility. The system is configured to apply a signal modification that mitigates the impact of reverberation on intelligibility.

In one embodiment, the system is configured to apply a modification, producing a modified frame power, based on an estimate of the contribution to the reverbed speech due to late reverberation.

Signal portions with low importance often have high energy. Reducing the power of these portions improves the detectability of adjacent sounds of higher importance and prominence. In an embodiment, the system takes account of the frame importance when applying the modification.

The system may be further configured to apply a time-scale modification.

Figure 2:
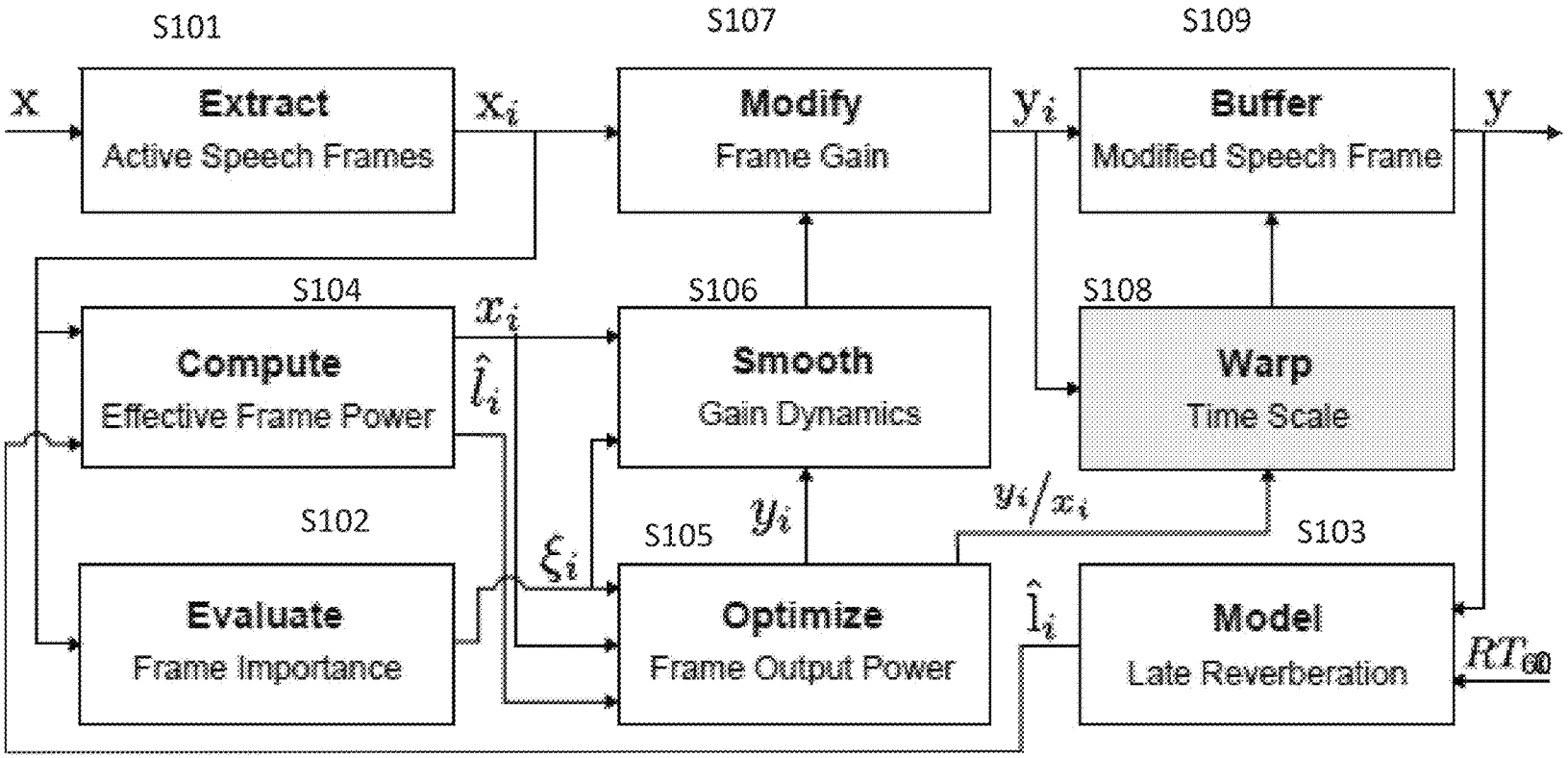
FIG. 2 is a flow diagram showing a method of enhancing speech in accordance with an embodiment.

A speech modification framework taking these aspects into consideration is described in relation to FIG. 2. An implementation of the framework is described in relation to FIG. 8.

In the framework, the input speech signal is split into overlapping frames for which frame importance evaluation is performed. In other words, each of the frames is characterized in terms of its information content. In parallel, a statistical model of late reverberation provides an estimate of the expected reverberant power at the resolution of the speech frame, i.e. the contribution to the frame power of the reverbed speech from late reverberation. An auditory distortion criterion is optimized to determine the frame-specific power gain adjustment. The criterion is composed of an auditory distortion measure and a penalty on the output power. The penalty term T is a function of the late reverberation power l, the power gain, and a multiplier $\lambda$, wherein the function is a non-linear function of l configured to increase with l faster than the distortion measure above a critical value of the late reverberation power. $\lambda$ is made a function of the frame importance. The estimate of the expected late reverberant power is included in the distortion measure as uncorrelated, additive noise. The criterion is used to derive the prescribed frame power, which is used to determine an optimal modification for a given frame. The frame importance, reverberation power and input power together are thus used to compute the optimal output power for a given frame.

When the late reverberation power is low, the distortion is the dominant term and the prescribed power gain, that is the ratio of the prescribed frame power to the power of the extracted frame, increases with late reverberation power, depending on the frame importance. Once the late reverberation power increases above a critical value, the penalty term starts to dominate, and the power gain starts to decrease with increasing late reverberation power, again depending on the frame importance.

In an embodiment, if the prescribed frame power is reduced from the input frame power and the late reverberation power is greater than the critical value, time warping is initiated. The time warp may be of the order of one pitch period and subject to smoothness constraints.

FIG. 2 shows a schematic illustration of the processing steps provided by program 5 in accordance with an embodiment, in which speech received from a speech input 15 is converted to enhanced speech to be output by an enhanced speech output 17.

Blocks S101, S107 and S109 are part of the signal processing backbone. Steps S102 and S103 incorporate context awareness, including both acoustic properties of the environment and local speech statistics.

In an embodiment, the input speech signal is split into overlapping frames and each of these is characterized in terms of information content, or frame importance. In parallel, a statistical model of late reverberation provides an estimate of the expected reverberant power at the resolution of the speech frame. Optimizing a distortion criterion determines the locally optimal output power, referred to as prescribed frame power. Locally, the power of late reverberation is modelled as uncorrelated, additive noise. In the event that the ratio of the modified frame power to the power of the extracted frame is less than 1 and the late reverberant power is greater than the critical value, time warping, or slow-down, is initiated, subject to a smoothing constraint.

Step S101 is "Extract active speech frames". This step comprises extracting overlapping frames from the speech signal x received from the speech input 15. The frames may be windowed, for example using a Hann window function.

Frames $x_i$ are output from the step S101.

Step S102 is "Evaluate frame importance". In this step, a measure of the frame importance is determined.

The frame importance characterizes the dissimilarity of the current frame to one or more previous frames. In an embodiment, the frame importance characterizes the dissimilarity to the adjacent previous frame. Low dissimilarity indicates less new information and therefore lower importance. Lower frame importance corresponds to higher redundancy. A frame with a low dissimilarity to previous frames, and thus high redundancy, has a low frame importance. Frame importance reflects the novelty of the frame and is used to limit the maximum boosting power.

The output of this step for each frame $x_i$ is the corresponding frame importance value $\xi_i$.

The frame importance is based on measuring the auditory domain dissimilarity between the current and one or more previous frames, for example by assessing the change between two consecutive frames in an auditory domain. In an embodiment, the frame importance is a measure of the dissimilarity of the mel cepstra of the frame to the previous frame. An estimate of the frame importance may be given by the normalized distance of the Mel frequency cepstral coefficients (MFCCs) in adjacent frames. In one embodiment, the frame importance is given by:

$$\xi_i = \frac{\| m_i - m_{i-1} \|}{\| m_i \| + \| m_{i-1} \|} \tag{1}$$

where $m_i$ represents the set of Mel frequency cepstral coefficients (MFCCs) derived from signal frame i, i.e. the MFCC vector at frame i.

The frame importance is a causal estimator, in other words it is not necessary for a future frame to be received in order to determine the frame importance of the current frame.

For the above relationship given in equation (1), $\xi_i \epsilon (0,1)$. This means that the frame importance parameter approximates the information content, where $\xi_i \rightarrow 0$ corresponds to low information content and $\xi_i \leq 1$ corresponds to high information content.

Figure 3:
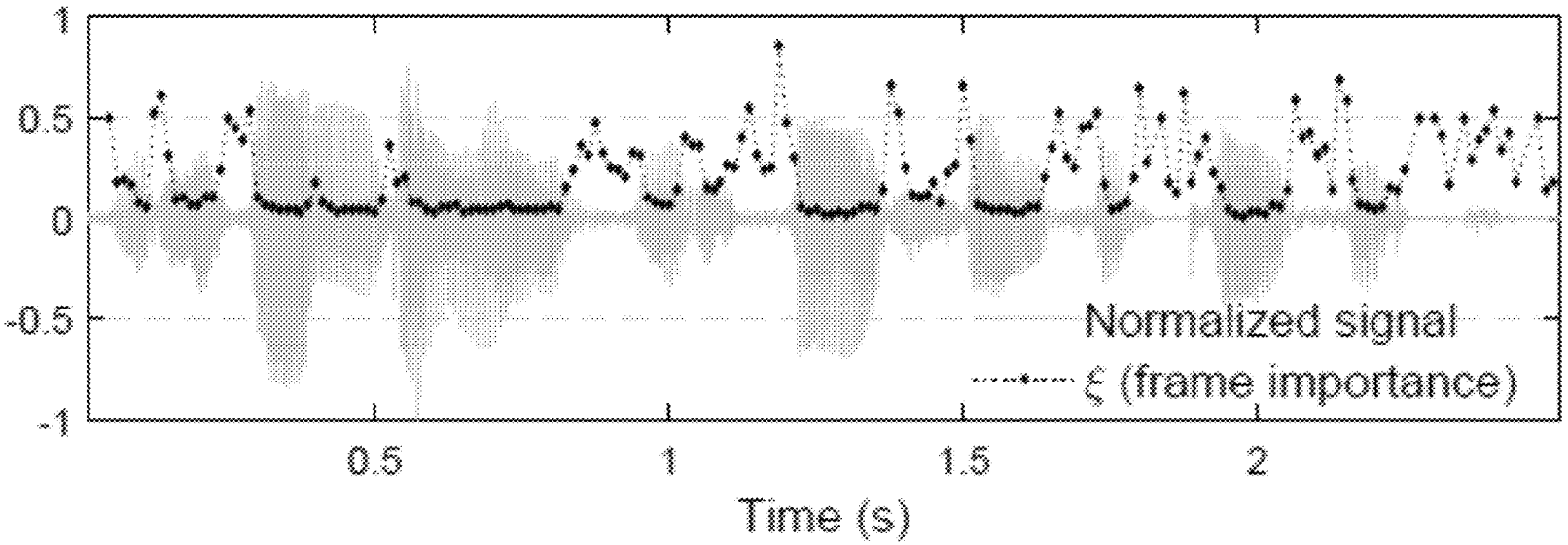
FIG. 3 shows the active-frame importance estimates for a test utterance.

FIG. 3 shows the active-frame importance estimates for a test utterance. The test utterance is a randomly selected short utterance from a UK English recording. The frame importance is on the vertical axis, against time in seconds on the horizontal axis. The input speech signal is also shown. Regions of higher redundancy have a lower frame importance than regions containing transitions.

In this embodiment, the information content of a segment, or frame, is approximated with a simple estimator. The frame importance calculated is an approximation describing the information content on a continuous scale. Explicit probabilistic modelling is not used, however the adopted parameter space is capable of approximating the information content with a high resolution, i.e. with a continuous measure, as opposed to a binary classifier.

A rigorous estimation of the amount of information in the speech signal at a given time using probabilistic modelling and the notion of entropy can alternatively be used to determine a measure of the frame importance.

Step S103 is "Model late reverberation".

Reverberation can be modelled as a convolution between the impulse response of the particular environment and the signal. The impulse response splits into three components: direct path, early reflections and late reverberation. Reverberation thus comprises two components: early reflections and late reverberation.

Early reflections have high power, depend on the geometry of the space and are individually distinguishable. They arrive within a short time window after the direct sound and are easily distinguishable when examining the room impulse response (RIR). Early reflections depend on the hall geometry and the position of the speaker and the listener. Early reflections arrive within a short interval, for example 50 ms, after the direct sound. Early reflections are not considered harmful to intelligibility, and in fact can improve intelligibility.

Late reverberation is diffuse in nature due to the large number of reflections and longer acoustic paths. It is the primary factor for reduced intelligibility due to masking between neighbouring sounds. This can be relevant for communication in places such as train stations and stadiums, large factories, concert and lecture halls. Identifying individual reflections is hard because their number increases while their magnitudes decrease. Late reverberation is considered more harmful to intelligibility because it is the primary cause of masking between different sounds in the speech signal. Late reverberation is the contribution of reflections arriving after the early reflections. Late reverberation is composed of delayed and attenuated replicas that have reflected more times than the early reflections. Late reverberation is thus diffuse and comprises a large number of reflections with diminishing magnitudes.

The late reverberation model in step S103 is used to assess the reverberant power that is considered to have a negative impact on intelligibility at a given time instant, i.e. that decreases intelligibility at a given time instant. The model outputs an approximation to the contribution to the reverbed speech frame due to late reverberation.

The boundary $t_l$ between early reflections and late reverberation in a RIR is the point where distinct reflections turn into a diffuse mixture. The value of $t_l$ is a characteristic of the environment. In an embodiment, tl is in the range 50 to 100 ms after the arrival of the sound following the direct path, i.e. the direct sound. $t_l$ seconds after the arrival of the direct sound, individual reflections become indistinguishable. This is thus the boundary between early reflections and late reverberation.

In step S103, the late reverberation is modelled, i.e. the contribution to the reverbed speech frame due to late reverberation is approximated. In one embodiment, the late reverberation can be modelled accurately to reproduce closely the acoustics of a particular hall. In alternative embodiments, simpler models that approximate the masking power due to late reverberation can be used, because the objective is power estimation of the late reverberation. Statistical models can be used to predict late reverberation power.

In an embodiment, the late reveberant part of the impulse response is modelled as a pulse train with exponentially decaying envelope. In an embodiment, the Velvet Noise model can be used to model the contribution due to late reverberation.

Figure 4:
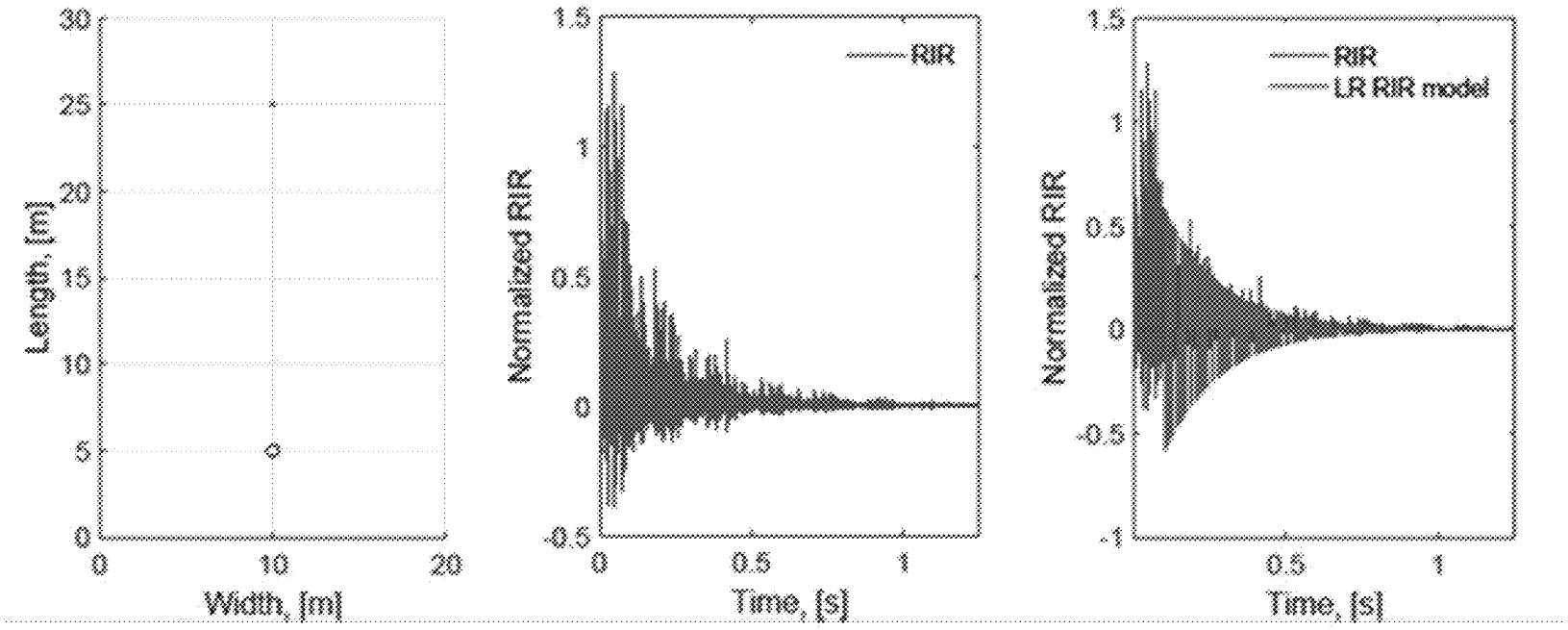
FIG. 4 shows three plots relating to use of the Velvet Noise model to model the late reverberation signal.

FIG. 4 shows three plots relating to use of the Velvet Noise model to model the late reverberation signal.

The first plot shows an example acoustic environment, which is a hall with dimensions fixed to 20 m×30 m×8 m, the dimensions being width, length and height respectively. Length is shown on the vertical axis and width is shown on the horizontal axis. The speaker and listener locations are {10 m, 5 m, 3 m} and {10 m, 25 m, 1.8 m} respectively. These values are used to generate the model RIR used for illustration of an RIR in the second plot. For the late reverberation power modelling, the particular locations of the speaker and the listener are not used.

The second plot shows a room impulse response where the propagation delay and attenuation are normalized to the direct sound. Time is shown on the horizontal axis in seconds. The normalized room impulse response shown here is a model RIR based on knowledge of the intended acoustic environment, which is shown in the first plot. The model is generated with the image-source method, given the dimensions of the hall shown in the first plot and a target $RT_{60}$.

The room impulse response may be measured, and the value of the boundary $t_l$ between early reflections and late reverberation and the reverberation time $RT_{60}$ can be obtained from this measurement. The reverberation time $RT_{60}$ is the time it takes late reverberation power to decay 60 dB below the power of the direct sound, and is also a characteristic of the environment.

The third plot shows the same normalised room impulse response model $\tilde{h}$ as the second plot, as well as the portion of the RIR corresponding to the late reverberation, discussed below. The late reverberation model is generated using the Velvet Noise model.

In one embodiment, the model of the late reverberation is based on the assumption that the power of late reverberation decays exponentially with time. Using this property, a model is implemented to estimate the power of late reverberation in a signal frame. A pulse train with appropriate density is generated using the framework of the Velvet Noise model, and is amplitude modulated with a decaying function.

The late reverberation room impulse response model is obtained as a product of the pulse train l[k] and the envelope e[k]:

$$\tilde{h}[k]=l[k]e[k] \tag{2}$$

where e[k] is given by equation (5) below, and l[k] is a pulse train, and is given by equation (3) below:

$$l[k] = \Sigma_{m=0}^{M} a[m]u\left[k - \text{round}\left(\frac{T_d}{T_s}(m + rnd(m))\right)\right] \tag{3}$$

where a[m] is a randomly generated sign of value +1 or −1, rnd(m) is a random number uniformly distributed between 0 and 1, "round" denotes rounding to an integer, $T_d$ is the average time in seconds between pulses and $T_s$ is the sampling interval. u denotes a pulse with unit magnitude. This pulse train is the Velvet Noise model.

In an embodiment, the late reverberation pulse train is scaled. An initial value is chosen for the pulse density. In an embodiment, an initial value of greater than 2000 pulses/second is used. In an embodiment an initial value of 4000 pulses/second is used. The generated late reverberation pulse train is then scaled to ensure that its energy is the same as the part of a measured RIR corresponding to late reverberation. A recording of an RIR for the acoustic environment may be used to scale the late reverberation pulse train. It is not important where the speaker and listener are situated for the recording. The values of $t_l$ and $RT_{60}$ can be determined from the recording. The energy of the part of the RIR after $t_l$ is also measured. The energy is computed as the sum of the squares of the values in the RIR after point $t_l$. The amplitude of the late reverberation pulse train is then scaled so that the energy of the late reverberation pulse train is the same as the energy computed from the RIR.

Any recorded RIR may be used as long as it is from the target environment. Alternatively, a model RIR can be used.

The continuous form of the decaying function, or envelope, is:

$$e(t) = 10^{-3\frac{t}{T_{60}}}. \tag{4}$$

The discretized envelope is given by:

$$e[k] = 10^{-3\frac{t/T_S}{T_{60}/T_S}} = 10^{-3\frac{k}{T_{60}/T_S}} \tag{5}$$

This relationship ensures a 60 dB power decay between the initial instant, t=0, which corresponds to the arrival of the direct path, and the reverberation time $RT_{60}$. $T_s$ is the sampling interval of the input speech signal, where:

$$T_s = 1/f_s \tag{6}$$

and $f_s$ is the sampling frequency.

The model of the late reverberation represents the portion of the RIR corresponding to late reverberation as a pulse train, of appropriate density, that is amplitude-modulated with a decaying function of the form given in (2).

An approximation to the late reverberation signal $\hat{l}$, which is the noise caused by late reverberation, for the duration of the target frame is computed from:

$$\hat{l}[k] = \sum_{n=1}^{(RT_{60}-t_l)f_s} \tilde{h}[t_l f_s + n]\, y[k - t_l f_s - n] \tag{7}$$

where $\tilde{h}$ is the late reverberation room impulse response model, given in (2), i.e. the artificial, pulse-train-based impulse response, $f_s$ is the sampling frequency and the beginning of the target frame is associated with time index k=0.

Thus equation (5) is the envelope applied to the pulse train in (3) to generate $\tilde{h}$. From equation (5), at k=0, e(t)=1, meaning there is no decay for the direct path, which is used as the reference. At $k=RT_{60}/T_s$. $e(t)=10^{-3}$, which in the power domain corresponds to −60 dB.

$y[k-t_l f_s-n]$ corresponds to a point from the output "buffer", i.e. the already modified signal corresponding to previous frames $x_p$, where p<i. The convolution of $\tilde{h}$ from $t_l$ onwards and the signal history from the output buffer give a sample or model realization of the late reverberation signal.

A sample-based late reverberation power estimate l is computed from $\hat{l}[k]$. For a frame i, the value of $\hat{l}[k]$ for each value of k is determined, resulting in a set of values $\hat{l}$, where each value corresponds to a value of k inside the frame.

Values for $RT_{60}$, $t_l$, $T_d$ and $f_s$ may be stored in the storage 7 of the system shown in FIG. 1.

Step S103 may be performed in parallel to step S102.

The following steps S104 and S105, are directed to calculating a prescribed frame power that optimises the distortion criterion between the natural speech and the modified speech plus late reverberant power. In step S104, the frame power of the input speech signal and the estimated late reverberation signal are calculated. In step S105, the frame power values of the input speech signal $x_i$ and the late reverberation signal $\hat{l}_i$ are used to calculate the prescribed frame power y that minimizes a distortion measure, subject to some penalty term which is a function of the late reverberant frame power l, the ratio of the prescribed frame power to the power of the input speech frame, and a multiplier λ, wherein the function is a non-linear function of l configured to increase with l faster than the distortion measure above a critical value, and wherein λ is a function of the frame importance. The frame of input speech is then modified such that is has a modified frame power in step S107, by applying a signal gain. The modification is calculated from the prescribed frame power. The modification may be calculated by further applying a post-filtering and/or smoothing to the value of the signal gain calculated directly from the prescribed frame power.

A distortion measure is used to evaluate the instantaneous, which in practice is approximated by frame-based, deviation between a set of signal features, in the perceptual domain, from clean and modified reverberated speech. Minimizing distortion provides the locally optimal modification parameters.

Step S104 is "Compute frame powers". The frame power $x_i$ for each frame of the input speech signal $x_i$ is calculated. The frame power $l_i$ for the late reverberation signal $\hat{l}_i$ calculated in S103 is also calculated. The frame power for the late reverberation signal $\hat{l}_i$ is the contribution $l_i$ to the frame power of the reverbed speech due to late reverberation.

In an alternative embodiment, the fraction of the frame power of the input speech signal $x_i$ in each of two or more frequency bands is calculated, and the fraction of the frame power of the late reverberation signal $\hat{l}_i$ calculated in S103 in each of the frequency bands is calculated. In an embodiment, the bands are linearly spaced on a MEL scale. In an embodiment, the bands are non-overlapping. In an embodiment, there are 10 frequency bands.

In an embodiment, the bands of the input speech frame are ranked in order of descending power. In other words, for each frame, the order of the frequency bands in descending power is determined. The bands corresponding to a predetermined fraction of the total frame power in descending order are then determined. For example, the bands in which 90% of the total frame power is contained in descending order are determined. For example, in a first frame, 90% of the frame power may come from the n highest power bands. In a second frame, 90% of the frame power may come from the m highest power bands, the m highest power bands in the second frame being different to those in the first frame.

The frame power of the late reverberation signal is then determined as the total power in those bands determined for the corresponding input speech frame. For the above example, in the first frame, the late reverberant frame power is calculated as the power of the late reverberation signal in the n bands. In the second frame, the late reverberant frame power is calculated as the power of the late reverberation signal in the m bands. The frame power of the late reverberation signal is thus calculated by summing the band powers of the bands determined from the input speech frame.

The frame power of the input speech signal may then be calculated by summing the band powers for all the bands of the input speech frame, i.e. not just the determined bands. The frame power of the input speech signal is $x_i$ and the frame power of the late reverberation noise signal is $l_i$. In this embodiment, the late reverberation frame power is computed from certain spectral bands only. The spectral bands are determined for each frame by determining the spectral bands of the input speech frame corresponding to the highest powers, for example, the highest power spectral bands corresponding to a predetermined fraction of the frame power. This takes into account the different spectral energy distributions of different sounds.

Step S105 is "Optimise frame output power".

A prescribed frame power is calculated. The prescribed frame power minimizes a distortion measure, subject to some penalty term which is a function of l, the ratio of the prescribed frame power to the power of the input speech frame, and a multiplier λ, wherein the function is a non-linear function of l configured to increase with l faster than the distortion measure above the critical value. The prescribed frame power is calculated subject to λ being a function of the frame importance.

In one embodiment, an iterative method is used to determine the prescribed frame power. For the first iteration, the distortion between the unmodified speech and the unmodified speech plus reverberation noise is evaluated, subject to the penalty term. This is output as the modified speech frame $y_i$. This is then repeated, for the new modified speech frame $y_i$. These steps are iterated, to find the prescribed frame power that reduces the distortion calculated, subject to the penalty term. In another embodiment, calculating a prescribed frame power value comprises using a searching algorithm to find a local minimum for the prescribed frame power, subject to the penalty term.

In one embodiment, there is a closed form solution to the optimization problem. In this case an iterative search for the optimum prescribed frame power is not performed. In step S105 the values for frame importance, frame power of the input signal $x_i$ and frame power of the late reverberation signal $l_i$ are inputted into an equation for the prescribed frame power, which corresponds to the solution of the optimization problem. There may be some further alteration to the signal gain calculated from the prescribed frame power before it is applied, for example a smoothing filter. The signal gain is applied in step S107. There is no iteration to determine the prescribed frame power in this case. The prescribed frame power is simply calculated from a predetermined function. In this embodiment, the speech modification has low-complexity.

A set of processing steps S105 to S107 in accordance with an embodiment in which there is a closed-form solution to the optimization problem are now described.

In these steps, the function for the prescribed frame power is determined by minimizing a distortion measure in the power domain, subject to a penalty term, wherein the penalty term is a function of l, the ratio of the prescribed frame power to the power of the input speech frame, and a multiplier λ, wherein the function is a non-linear function of l configured to increase with l faster than the distortion measure above a critical value of l, and wherein λ is a function of the frame importance. In these steps, the prescribed power of the frame is calculated using a function which minimises the distortion criterion.

A composite criterion, comprising the distortion term and a power increase penalty, is used to prevent excessive increase in output power. To facilitate the analysis, late reverberation is locally, i.e., for the duration of the current frame, regarded as uncorrelated, additive noise. This is motivated by i) the time separation between the current frame and the period when the interfering speech was produced and ii) the long-term non-stationary nature of the speech signal. Late reverberation is thus considered as additive and uncorrelated with the signal, due to the differences in propagation time and noise.

Any composite distortion criterion for speech in noise having a distortion term and a power gain penalty, the power gain penalty being configured to decrease the power gain as the contribution to late reverberation increases above a critical value, can be used to determine a prescribed frame power in this step. A speech in noise criterion is used because late reverberation can be interpreted as additive uncorrelated non-stationary noise.

In one embodiment, a criterion composed of an auditory distortion measure and a constraint on the output power is used to derive the optimal prescribed modified frame power at a given time:

$$\eta = \int_{\alpha}^{\beta} \left( \frac{1}{x} \left( y + l - x \frac{dy}{dx} \right)^2 + \lambda l^2 \frac{y}{x} \right) f_X(x \mid b) dx \tag{8}$$

where x, y and l are the instantaneous powers of the waveforms x, y and l, in practice approximated by frame powers. Italic font is used to indicate the frame powers. Thus for a particular frame there is a value x, where x is the frame power of the original frame of speech signal. There is also a value of l, where l is the power of the noise in that frame, estimated in step S103. The prescribed modified power for the frame is denoted by y.

In equation (8), the penalty term T is $$T = \lambda l^2 \frac{y}{x}.$$

In general however, any penalty term T which is a function of l, the ratio of the prescribed frame power to the power of the input frame, and a multiplier λ, wherein the function is a non-linear function of l configured to increase with l faster than the distortion measure above a critical value can be used. For example, the penalty term may be may be:

$$T \propto \lambda l^w \frac{y}{x} \tag{9}$$

where w>1. In an embodiment, $$T = \lambda l^w \frac{y}{x}.$$

Thus the first additive term in the criterion is the distortion in the instantaneous power dynamics. In an embodiment, the instantaneous late reverberation power in the power gain penalty term is raised to a power larger than unity. In an embodiment, the late reverberation power in the power gain penalty term is raised to a power 2. A power of 2 facilitates the mathematical analysis for calibrating the mapping function. An increase of l past a critical value causes the power gain penalty to outweigh the distortion, and induces an inversion in the modification direction.

For speech signals in a reverberant environment, the intelligibility is reduced because the late reverberation from earlier speech overlaps and masks the current speech. Increasing the power of the speech in order to increase the intelligibility also increases the amount of late reverberation caused, and thus can actually have a detrimental effect on the intelligibility. The penalty term acts to suppress the increase in power subject to the frame importance. Furthermore, above a critical value of late reverberation, the ratio of the modified frame power to the power of the extracted frame decreases with late reverberation. Thus for a particular input frame power and frame importance, as late reverberation increases but remains below the critical value, the prescribed frame power increases. As late reverberation increases further above the critical value, the prescribed frame power decreases. This self-suppressing behaviour allows the system to be used in highly reverberant environments.

The penalty term is configured to increase with l faster than the distortion measure above the critical value. Above the critical value of l, the ratio of the prescribed frame power to the input speech frame power decreases with increasing l.

β and α are bounds for the interval of interest. In other words, and β and α bound the optimal operating range. In one embodiment, the parameter α is set to the minimum observed frame powers in a sample data set of pre-recorded standard speech data, with normalised variance. In one embodiment, the upper bound β is the highest expected short-term power in the input speech. Alternatively, β is the maximum observed frame power in pre-recorded standard speech data.

$f_x(x|b)$ is the probability density function of the Pareto distribution with shape parameter b. The Pareto distribution is given by:

$$f_X(x\,|\,b) = \frac{b\alpha^b}{x^{1+b}},\ x \in [\alpha, \infty) \tag{10}$$

The value of b is obtained from a maximum likelihood estimation for the parameters of the (two-parameter) Pareto distribution fitted to a sample data set, for example the standard pre-recorded speech used to determine α and β. The Pareto distribution may be fitted off-line to variance-equalized speech data, and a value for b obtained. In one embodiment, b is less than 1.

Thus, in an embodiment, the parameter α may be set to the minimum observed frame powers in the data used for fitting fX(x|b) and the parameter β may be set to the maximum observed frame power in the data used to fit fX(x|b). Consistency between the estimates for α and β and the frame powers may be achieved when the utterances in the data used to fit fX(x|b) are the same power as the input speech signal. The power referred to here is a long-term power measured over several seconds, for example, measured over a time scale that is the same as the utterance duration.

In an embodiment, the values of β and α are scaled in real time. If the long-term variance of the input speech signal is not the same as that of the data to which the Pareto distribution is fitted, the parameters of the Pareto distribution are updated accordingly. The long-term variance of the input speech is thus monitored and the values of the parameters β and α are scaled with the ratio of the current input speech signal variance and the reference variance, i.e. that of the sample data. The variance is the long term variance, i.e. on a time scale of 2 or more seconds.

Values for b, α and β may be stored in the storage 7 of the system shown in FIG. 1 and updated as required.

The first term under the integral in equation (8) is the distortion in the instantaneous power dynamics and the second term is the penalty on the power gain. This distortion criterion is used due to the flexibility and low complexity of the resulting modification. The late reverberant power l is included in the distortion term as additive noise. The term λ is a multiplier for the penalty term. The penalty term also includes a factor $l^2$. In general, the penalty term is a function of l, the ratio of the prescribed frame power to the input speech power y|x, and a multiplier λ, wherein the function is a non-linear function of l configured to increase with l faster than the distortion measure above a critical value, and wherein λ is a function of the frame importance.

The solution in closed form for the minimum of the functional (8) found by using calculus of variations is:

$$y = c_1 x + c_2 x^b + \frac{l}{2b}(l\lambda - 2b) \tag{11}$$

where $c_1$ and $c_2$ are constants identified by setting the boundary conditions as:

$$y(\alpha)=\alpha \tag{12}$$

$$\begin{aligned} &\rho = \varsigma^{-1} \\ &y'(\psi) = \rho,\ \varsigma \in (0, 1) \\ &\psi \to \infty \end{aligned} \tag{13}$$

where $$y' = \frac{dy}{dx}.$$

Equation (11) is the solution for the case for w=2. The form of the solution for the more general case where w>1 is:

$$y = c_1 x + c_2 x^b + \frac{l}{2b}(l^{w-1}\lambda - 2b)$$

Where the penalty term is a function other than l raised to the power of w, the solution will have a different form.

The parametrization p(l) ensures that in the absence of reverberation, i.e. where y'(ψ)=1, the input-output (IO) relationship (11) passes the input unchanged, i.e. y=x.

The values for $c_1$ and $c_2$ are thus dependent on λ and are given by:

$$c_1 = \frac{2b(\alpha^b\rho\psi - \alpha b\psi^b) + bl\psi^b(l\lambda - 2b)}{2b(\alpha^b\psi - \alpha b\psi^b)}, \tag{14}$$

$$c_2 = \frac{2\alpha b\psi(1-\rho) + l\psi(2b - l\lambda)}{2b(\alpha^b\psi - \alpha b\psi^b)}. \tag{15}$$

$y_i$ is the prescribed power of the modified speech frame. The prescribed signal gain, i.e. the prescribed modification, for a frame i is thus $\sqrt{yi/xi}$, i.e. is the square root of the ratio of the prescribed frame power to the power of the input frame.

The integrand is a Lagrangian and λ is a Lagrange multiplier. The distortion criterion is subject to an explicit constraint, i.e. an equality or inequality. In an embodiment, the constraint is $$l^{\nu}\frac{y}{x} \le Q$$

for some value of Q. This prevents the power gain growing excessively. The Q falls off in the formulation of the Euler-Lagrange equation, and the constraint is thus implicitly in equation (8). In order to incorporate the frame importance, the term λ is parametrized such that it has a dependence on the frame importance through υ. The frame importance is introduced to limit the increase of the gain. This avoids introducing the frame importance through Q, e.g. by making Q a function of the frame importance through υ, and determining the value of λ once the solution to the Euler-Lagrange equation is found. Calibration is also performed to determine the value for λ, as described below. Calibration is used to set the turning point in the gain with increase in late reverberation power.

A value for λ for each frame may be calculated as described below. The value of λ for the target frame i is calculated in step S105.

An increase in the late reverberation power induces an increase in the speech output power. This behaviour can lead to instability due to recursive increase of signal power. In other words, increasing the speech power in a reverberant environment also increases the power of the late reverberation. The penalty term prevents this recursive increase and instability. The penalty term means that there is a critical value of late reverberant power $\tilde{l}$, above which the power gain, i.e. the ratio of the prescribed frame power to the power of the extracted frame, starts to decrease.

If the critical value is too high, too much reverberation is generated. This is prevented by calibration of the system, described below. The calibration is realised by determining the expressions for λ below. During processing of the speech, a value of λ for each frame is calculated from the expressions.

For any value of late reverberant power l and multiplier λ there is a maximum boosting power (MBP). The MBP is the crossing point of the power mapping curve y(x), i.e. which provides the prescribed frame power, and the function y=x. An input speech power below the MBP is boosted and an input speech power above the MBP is suppressed.

As a result of the calibration, at low values of late reverberant power, the MBP is allowed to increase with increasing late reverberation power. There is also a dependence on the frame importance. Above the critical value of late reverberant power, the MBP decreases, again depending on the frame importance.

The calibration of the system and the derivation of the expressions for λ is described below.

The desired upper bound of the input-output power map is represented by a maximum boosting power β. As described above, β may be the maximum observed frame power in pre-recorded standard speech data for example. $\tilde{\lambda}$ is the Lagrange multiplier for which the input-output power map achieves this upper bound β at $l=\tilde{l}$, i.e. where:

$$y(x=\beta|l=\tilde{l},\lambda=\tilde{\lambda})=\beta \tag{16}$$

For $\lambda=\tilde{\lambda}$, the MBP will change direction at $l=\tilde{l}$, such that for $\lambda=\tilde{\lambda}$ and $l<\tilde{l}$, the MBP increases with l, for $\lambda=\tilde{\lambda}$ and $l>\tilde{l}$ the MBP decreases with increasing l.

Rearranging (16) along the powers of l gives the quadratic form:

$$Al^2+Bl+C=0 \tag{17}$$

The single root condition $B^2-4AC=0$ identifies the turning point of the input-output power map. Solving (11) for λ gives:

$$\tilde{\lambda} = \frac{b}{2(1-\rho)}\frac{\beta^b-\alpha^b-(\beta-\alpha)b\psi^{b-1}}{\alpha^b\beta-\alpha\beta^b} \tag{18}$$

Figure 5:
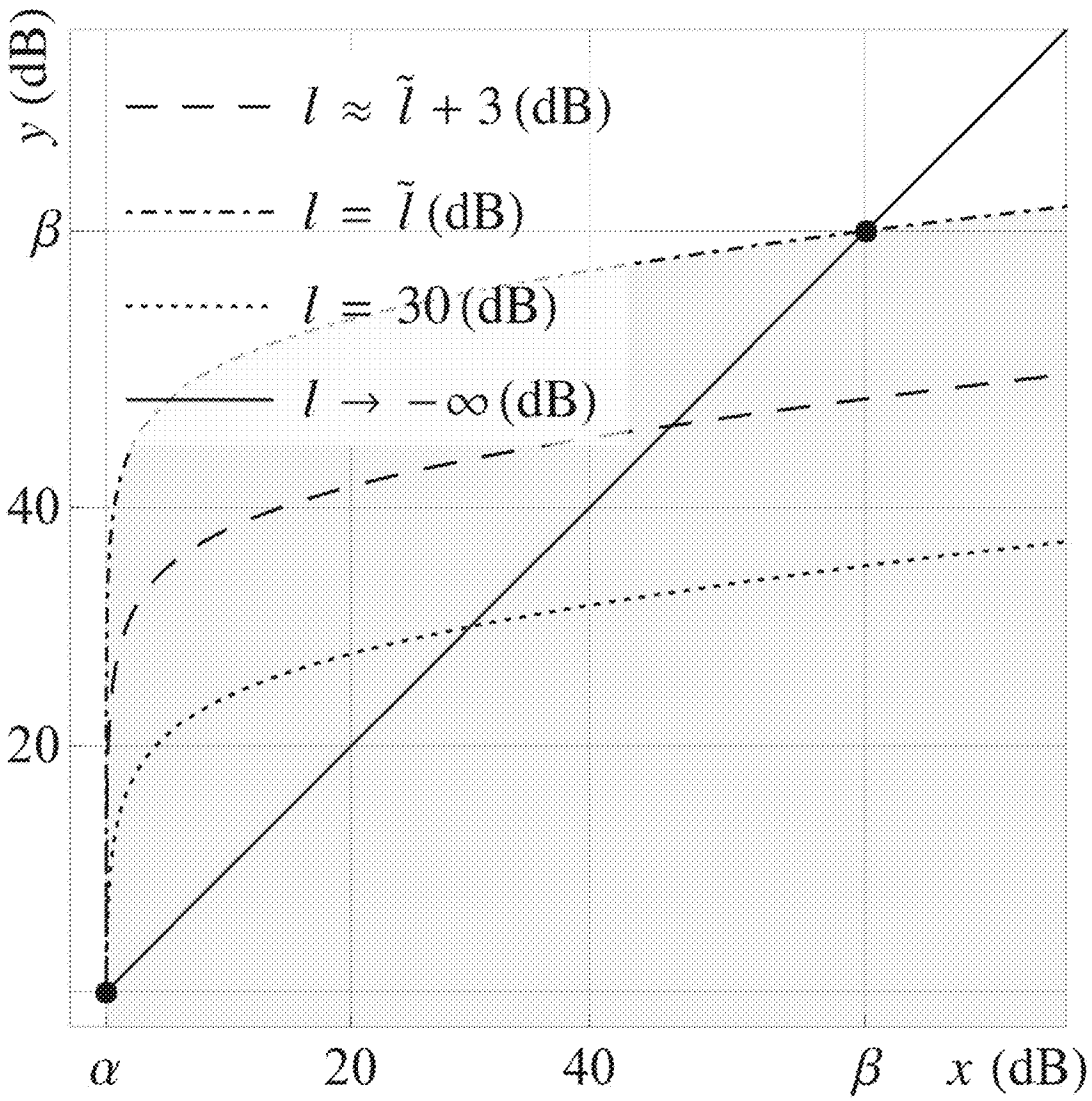
FIG. 5 is a plot of the prescribed power gain for $\lambda=\tilde{\lambda}$ and different late reverberation levels.

Mapping curves for different reverberation power levels and for $\lambda=\tilde{\lambda}$ are shown in FIG. 5. FIG. 5 shows the power gain for $\lambda=\tilde{\lambda}$ and different noise levels. FIG. 5 is a plot of the output in decibels (vertical axis) against the input in decibels (horizontal axis). Unity power gain is shown as a straight solid line. This corresponds to the case where $l\rightarrow-\infty$ dB, the reference power being 1. The power gain for l=30 dB is shown by the dotted line. The power gain for $l=\tilde{l}$ dB is shown by the dotted and dashed line. The power gain for $l=\tilde{l}+3$ dB is shown by the dashed line. The power is decreased with an increase in reverberation power beyond a critical reverberation power, marking the turning point. If $l=\tilde{l}$ and $\lambda=\tilde{\lambda}$, the MBP is β. If $l=\tilde{l}$ and $\lambda=\tilde{\lambda}$, the MBP is smaller than β.

The frame importance is also included in calculation of Δ, and prevents the MBP increase with late reverberant power below the critical value from exceeding a value $\nu_\xi$, and prevents too much suppression of a frame with a large amount of information content when the MBP is decreasing. An expression for Δ is derived which provides a particular MBP. This is used to determine expressions for Δ which control the increase and decrease of the MBP.

An expression for Δ that achieves a particular MBP for any value of l is derived below.

Solving the expression:

$$y(x=\upsilon,l,\lambda=\lambda_\nu)=\upsilon \tag{19}$$

for λ as for (16) yields the expression:

$$\lambda_\nu = \frac{2b}{l^2}\frac{(\rho-1)(\alpha^b\nu-\alpha\nu^b)}{\nu^b-\alpha^b-b(\nu-\alpha)\psi^{b-1}}+\frac{2b}{l} \tag{20}$$

$\lambda_\nu$ is the value of λ corresponding to a prescribed frame power $y(x=\nu,l,\lambda=\lambda_\nu)=\nu$. The fractional polynomial function (11), with derivative $y'(\psi)\geq 0$, is guaranteed to be monotonically increasing on $x\epsilon(\alpha;\psi)$ for $\lambda=\lambda_\nu,\nu>\alpha$. Where $\lambda=\lambda_\nu$ the MBP is fixed to the value ν, regardless of the late reverberant power l, that is the MBP is fixed with regard to the late reverberant power l.

This formula can be used to calculate a value for $\lambda_{\nu_\xi}$, which is used to control the increase of the MBP, i.e. for the region $l<\tilde{l}$. Where $\lambda=\lambda_{\nu_\xi}$ the MBP is fixed to the value $\nu_\xi$. There is no possibility for upward or downward movement from this value.

$\lambda_{\nu_\xi}$ is calculated from:

$$\lambda_{\nu_\xi} = \frac{2b}{l^2}\frac{(\varsigma^l-1)(\alpha^b\nu_\xi-\alpha\nu_\xi^b)}{\nu_\xi^b-\alpha^b-b(\nu_\xi-\alpha)\psi^{b-1}}+\frac{2b}{l} \tag{21}$$

In an embodiment, the sigmoid:

$$q(\Theta;s,H,L)=\frac{1-e^{-s\Theta}}{1+e^{-s\Theta}}(H-L)+L,\ \Theta>0 \tag{22}$$

with slope s and range limits L=α and H=ρ is used to map ξ to an maximum boosting power $\nu_\xi$ in the log domain.

$$\log(\nu_\xi) = \frac{1-e^{-s\xi}}{1+e^{-s\xi}}\{\log(\beta)-\log(\alpha)\}+\log(\alpha) \tag{23}$$

This provides a smooth mapping between frame importance and MBP.

Where $\lambda=\lambda_{\nu_\xi}$, the MBP is $\nu_\xi$ regardless of the value of l, as the relationship in (23) controls the crossing point of y(x) with y=x directly.

For the descent of the MBP, i.e. in the region l>1, an expression for $\lambda_{\bar{\nu}}$ is determined. $\lambda_{\bar{\nu}}$ is the value of λ corresponding to a prescribed frame power $y(x=\bar{\nu}, l, \lambda=\lambda_{\bar{\nu}})=\bar{\nu}$, wherein $\lambda_{\bar{\nu}}$ is calculated from:

$$\lambda_{\bar{\nu}} = \frac{2b}{l^2}\frac{(\varsigma^l-1)(\alpha^b\bar{\nu}-\alpha\bar{\nu}^b)}{\bar{\nu}^b-\alpha^b-b(\bar{\nu}-\alpha)\psi^{b-1}}+\frac{2b}{l} \tag{24}$$

Where $\lambda=\lambda_{\bar{\nu}}$ the MBP is fixed to the value $\ddot{\nu}$, regardless of the late reverberant power l, that is the MBP is fixed with regard to the late reverberant power l.

In an embodiment, the sigmoid:

$$q(\Theta; s, H, L) = \frac{1-e^{-s\Theta}}{1+e^{-s\Theta}}(H-L)+L,\ \Theta>0 \tag{25}$$

with slope s and range limits L=α and $H=\nu_\xi$ is used to map $$\frac{\lambda_{\nu_\xi}}{\tilde{\lambda}}$$

to an maximum boosting power $\bar{\upsilon}$ in the log domain.

$$\log(\bar{\nu}) = \frac{1-e^{-s\frac{\lambda_{\nu_\xi}}{\tilde{\lambda}}}}{1+e^{-s\frac{\lambda_{\nu_\xi}}{\tilde{\lambda}}}}\{\log(\nu_\xi)-\log(\alpha)\}+\log(\alpha) \tag{26}$$

This ensures that $\nu\epsilon[\alpha,\nu_\xi]$ and gives a lower bounded input output power map.

By introducing a dependence on ξ, through $\lambda_{\bar{\nu}}$ and $\lambda_{\nu_\xi}$, transitions are enhanced while overall late reverberation power is reduced.

Thus for each frame of the input speech signal, the value of $\tilde{\lambda}$ is calculated from (18). The critical value of the late reverberation power $\tilde{l}$ is then derived as $$\frac{b}{\tilde{\lambda}}.$$

Although $\tilde{\lambda}$ depends on l through ρ, in practice, the exponential convergence rate in ρ→0 with the increase of l indicates that $\tilde{l}$ does not vary for large l. Thus in an alternative embodiment, a single reference value for $\tilde{\lambda}$ and $\tilde{l}$ can be used.

The constants used in the expressions for $\lambda_{\bar{\nu}}$ and $\lambda_{\nu_\xi}$ may be determined from training data, for example during the calibration process, and stored in the storage 7. For example, a value for s may be stored in the storage 7 of the system shown in FIG. 1. In general, a smaller value of s leads to a less expressed response to ξ since the sigmoid will have a more gradual slope.

For each inputted speech frame, if $l\le\tilde{l}$, where $\tilde{l}$ is the critical value calculated for that frame, the value for λ for the frame is calculated from:

$$\lambda=\max(\lambda_{\nu_\xi},\tilde{\lambda}) \tag{27}$$

If $l>\tilde{l}$, the value of λ for the frame is calculated from:

$$\lambda=\lambda_{\bar{\nu}} \tag{28}$$

Figure 6:
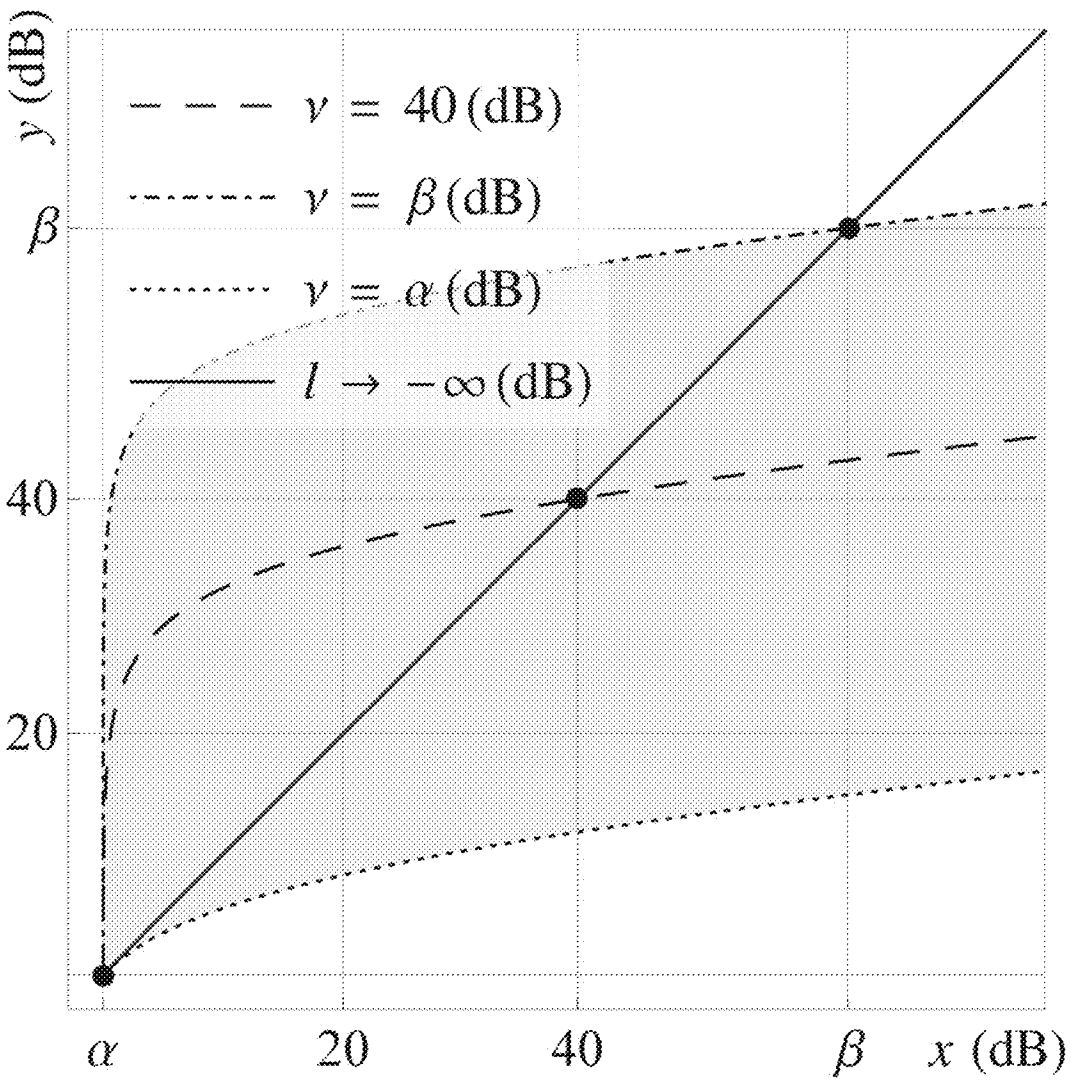
FIG. 6 is a plot of the prescribed power gain for $\lambda=\lambda_v$ and different values of v.

FIG. 6 shows the power gain for $\lambda=\lambda_\nu$ and different values of ν. FIG. 6 is a plot of the output in decibels (vertical axis) against the input in decibels (horizontal axis). Unity power gain is shown as a straight solid line. This corresponds to the case where l→−∞ dB. The power gain for ν=α dB is shown by the dotted line. The power gain for ν=βdB is shown by the dotted and dashed line. The power gain for ν=40 dB is shown by the dashed line.

An input speech power below the MBP is boosted and an input speech power above the MBP is suppressed. In high reverberation, the MBP is reduced, leading to a larger suppression and a smaller boosting range of powers.

The value of λ for the target frame i is calculated using equation (27) or (28), depending on the value of l relative to the critical late reverberation power. Establishing a connection between the frame importance parameter ξ and λ provides the possibility for short-term power suppression or power boosting as a function of the redundancy in the speech signal.

Once a value for λ has been calculated for the frame, values for $c_1$ and $c_2$ can be calculated. These values can then be substituted into (11) to compute the prescribed frame power $y_i$. The signal gain applied to the input speech signal can then be calculated from the prescribed frame power. In an embodiment, the modification is applied to the input speech signal by modifying the signal spectrum, using the signal gain $g_i$. In this case a signal gain $g_i$ is calculated from the prescribed modified frame power.

In an embodiment, the signal gain calculated from the prescribed frame power is smoothed before being applied to the input speech signal. This is step S106.

The smoothed signal gain applied to the frame of the speech received from the speech input may be calculated from:

$$\ddot{g}_i=\min(u,g_i) \text{ if } g_i>1$$

$$\ddot{g}_i=\max(d,g_i) \text{ if } g_i\le 1 \tag{29}$$

where $g_i$ is the signal gain calculated from the prescribed frame power, where $g_i^2=y_i/x_i$, $y_i$ being the prescribed frame power and $x_i$ being the frame power of the speech received from the speech input, $\ddot{g}_i$ is the smoothed signal gain and where:

$$u_i = \frac{1-e^{-s\xi_i}}{1+e^{-s\xi_i}}\left(U^{\phi\sqrt{g_i}}-1\right)+1, \tag{30}$$

$$d_i = \frac{1-e^{-s\xi_i}}{1+e^{-s\xi_i}}(1-D)+D \tag{31}$$

where s and ϕ are constants and $\xi_i$ is the frame importance, and U and D are selected to give the downward and upward limit rates. The operating rates converge to the limit rates with ξ.

The term $U^{\Phi}\sqrt{g_i}$ leads to greater power increase for weak transient components, without leading to excessive boosting elsewhere. If the input speech frame has a low frame power, and in particular if it has a high frame importance, for example a transient, the prescribed signal gain will be very high. In general this gives $g_i>>1$. This term thus allows for a stronger gain for such transients. In an embodiment ϕ=3. In an alternative embodiment, there are a range of possible values for ϕ, and a value is selected for each frame depending on some characteristic of the frame. For example, $\phi=\phi_1$ if over 50% of the spectral energy of a frame sits in a high-frequency region and $\phi=\phi_2$ if over 50% of the spectral energy of a frame sits in a low-frequency region.

This form of smoothing has the effect of limiting the rate of change of the signal gain, without smearing frame importance across adjacent frames, such that:

$$D \le \ddot{g}_i \le U^{\phi}\sqrt{g_i} \tag{32}$$

By controlling the rate of change, the modified signal has less perceptual distortion.

In an embodiment, there is a different rate for $g_i>1$ and $g_i \le 1$, i.e. a different value of s for equation (30) and (31).

In an alternative embodiment, u is calculated from $$u_i = \frac{1-e^{-sg_i}}{1+e^{-sg_i}}\left(U^{\phi/\sqrt{g_i}}-1\right)+1.$$

In an alternative embodiment, the signal gain is instead smoothed using a relative constraint. Equations (29) and (32) above are replaced with equations (29a) and (32a) below:

$$\ddot{g}_l = \min(u\ddot{g}_{i-1}, g_i) \quad \text{if } g_i > 1 \tag{29a}$$
$$\ddot{g}_l = \max(d\ddot{g}_{i-1}, g_i) \quad \text{if } g_i \le 1$$

$$D < \frac{\ddot{g}_l}{\ddot{g}_{l-1}} \le U \tag{32a}$$

Step S107 is "Modify speech frame". The windowed waveform corresponding to the input speech frame is scaled by $\ddot{g}_i$. The modification is thus the signal gain, calculated from equation (29) above for example. In an embodiment, the modification is applied to the input speech signal by modifying the signal spectrum, using the smoothed signal gain In the above described embodiments, the prescribed frame power is derived by optimizing a distortion measure that models the effect of late reverberation, subject to a penalty term. The signal gain is then calculated from the prescribed frame power.

The modification utilizes an explicit model of late reverberation and optimizes the frame power for the impact of the late reverberation which is locally treated as additive noise in a distortion measure. Any arbitrary distortion criterion for speech in noise can be used for the modification.

The modification mitigates the impact of late reverberation. Late reverberation can be modelled statistically due to its diffuse nature. At a particular time instant, late reverberation can be seen as additive noise that, given the time offset to the generation instant, or the time separation to its origin, can be assumed to be uncorrelated with the direct or shortest path speech signal. Boosting the signal is an effective intelligibility-enhancing strategy for additive noise since it improves the detectability of the sound. Suppressing this boosting above a critical late reverberation noise prevents excessive reverberation.

In an embodiment, the modified speech frames are simply overlap-added at this point, and the resulting enhanced speech signal is output.

Further speech enhancement is achieved by introducing an additional modification dimension. Under reverberation, boosting the signal can be counter-productive, as the boosted signal generates more noise in the future. Overlap-masking between sounds caused by acoustic echoes is a major contributor to the loss in intelligibility. Time-scaling reduces the effective overlap-masking between closely-situated sounds. Extending portions of the signal by time scaling results in reduced masking in these portions from previous sounds, as the late reverberation power decays exponentially with time. This effect improves intelligibility but also reduces the transmission rate. Slowing down the signal reduces the overlap-masking between closely situated sounds and improves intelligibility, but also slows down the transfer of information.

In an embodiment in which the system is configured to apply a modification which produces a modified frame power and a subsequent time scale modification, the time scale modification is performed in step S108.

Step S108 is "Warp time scale". In general, time scaling improves intelligibility by reducing overlap-masking among different sounds. The time-warping functionality searches for the optimal lag when extending the waveform. The method allows for local warping. Time warping occurs when the frame power is reduced below that of the unmodified input frame power and when the late reverberation power is above the critical value.

In this step, it is first determined whether the smoothed signal gain is less than 1, wherein the smoothed signal gain is $\ddot{g}_l$ and whether l is greater than $\tilde{l}$. If both these conditions are fulfilled then, using the history of the output signal y, the correlation sequence $r_{yy}(k)$ for a frame i is computed as:

$$r_{yy}[k] = \sum_{n=1}^{Tf_s} y[n-Tf_s]y[n-k] \tag{33}$$

where T is the frame duration (in seconds). The value for T may be stored in the storage 7 of the system shown in FIG. 1. The variable k is used in the context of time warping to denote a lag. It is not used as in the context of modelling the late reverberation.

The optimal lag, k*, is then calculated from:

$$k^* = \underset{k\in\{K_1,K_2\}}{\operatorname{argmax}}\ r_{yy}[k] \tag{34}$$

where the lag is a discrete time index, or sample index and $K_1$ and $K_2$ are the minimum and maximum lag of the search interval. In an embodiment, $K_1$ and $K_2$ are constants. In an embodiment, $K_1$ is 0.003 $f_s$ and $K_2$ is 0.02 $f_s$. The optimal lag is identified by the highest peak in the correlation function.

Figure 7:
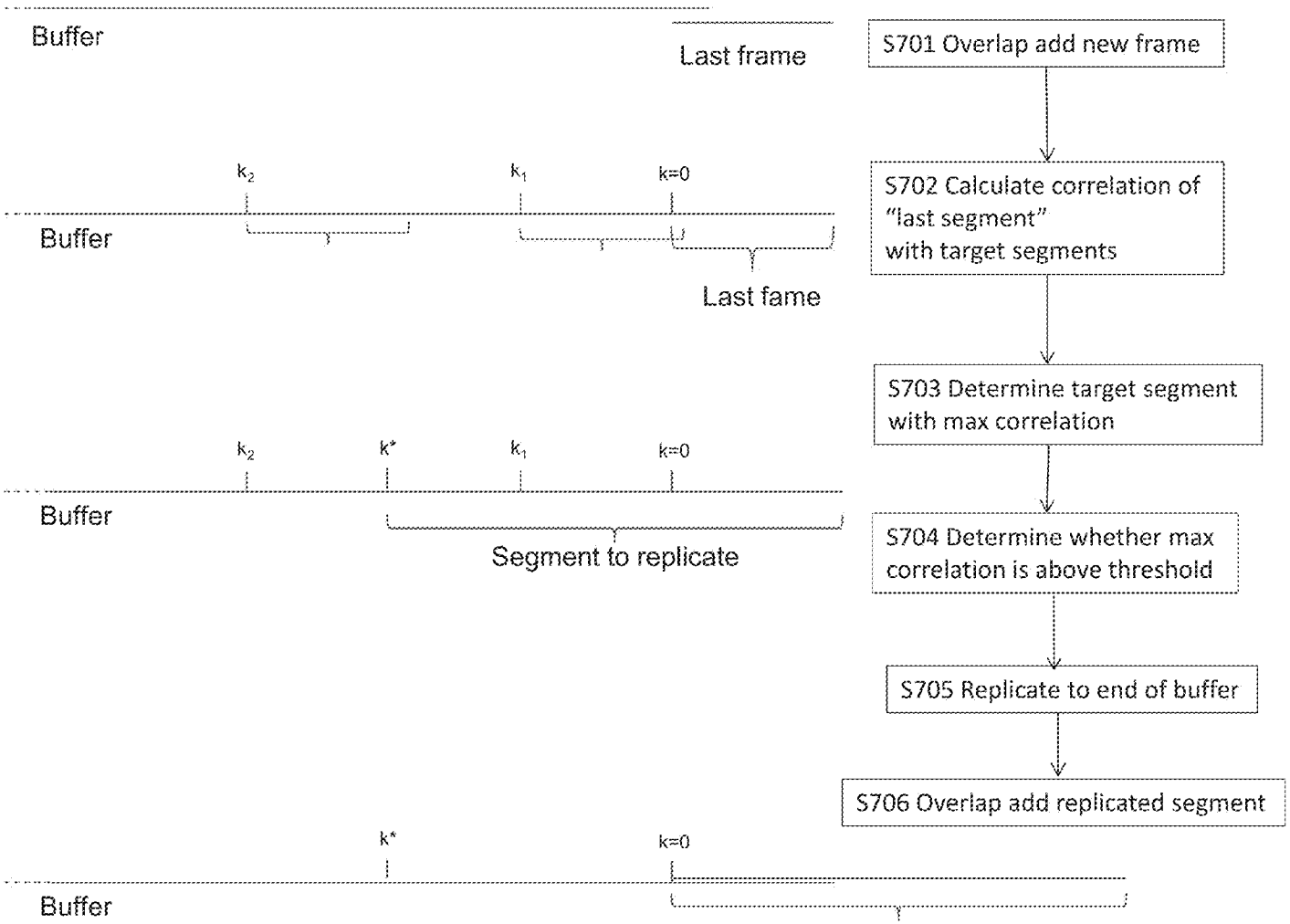
FIG. 7 is a schematic illustration of the time scale modification process which is part of a method of enhancing speech in accordance with an embodiment.

FIG. 7 is a schematic illustration of the time scale modification process according to an embodiment.

The modified frames after the overlap and add process performed in step S109 of FIG. 2 form an output "buffer".

In the time scale modification process, a new frame $y_i$ is output from step S107 of FIG. 2, having been modified. This frame is overlap-added to the buffer in step S109. This corresponds to step S701 of the time scale modification process shown in FIG. 7. The "new frame" is also referred to as the "last frame". The point k=0 is the start of the last frame.

All frames are overlap added to the buffer in this manner. However, if the following conditions are met then the time will be warped around this point, in the manner described in the following steps, the following conditions being that 1) the smoothed signal gain is less than 1, 2) l is greater than $\tilde{l}$, and 3) the max correlation is greater than a threshold value. The time warp is thus only initiated when suppression occurs while in "descent" mode, i.e. when reverberation is high and l is greater than $\tilde{l}$. If suppression occurs when $l \leq \tilde{l}$, for example due to low information content and high power of the frame, this will not be accompanied by time warp.

In step S108, it is desired to determine a time scale modification amount that will time warp the signal without introducing discontinuities. This involves calculating the correlation, from equation (33), of the "last frame" of the signal with a target segment of the buffer signal, starting from $k=K_1$ in equation (33). This is repeated for target segments corresponding to $k=K_{1-1}$ to $k=K_2$. This corresponds to step S702 of the time scale modification process.

The value of k corresponding to the maximum peak in the correlation function gives the optimum lag k*. This is determined in step S703 of the time scale modification process.

In step S704, it is determined whether the value of the maximum correlation is larger than a threshold value.

In an embodiment, the threshold value is the correlation value at a lag of k=0, i.e. of the last segment, multiplied by Ω, where $\Omega \epsilon (0, 1)$. The correlation value at lag of k=0 is the energy of the frame.

In an embodiment, the threshold value corresponds to the condition that the time warp is only performed if the condition;

$$r_{yy}[k^*] > \underset{\Omega \in (0,1)}{\Omega} r_{yy}[0] \tag{35}$$

is fulfilled. This condition prevents distortion due to attempting to warp a transient for example.

If the conditions are fulfilled, the time warping is applied. In another embodiment, the number of consecutive time-warps is limited to two, in order to prevent over-periodicity.

The buffer signal is then extracted from this point on, i.e. the segment of the buffer signal from k=k* to the end of the buffer is replicated in step S704, and this is overlap added with the "last frame" from the point k=0 in step S705. In an embodiment, the overlap-add is on a scale twice as large as that of the frame-based processing. In an embodiment, the waveform extension is over-lap added using smooth complementary "half" windows in the overlap area This overlap-adding therefore results in left over, or extra, samples at the end of the buffered signal, containing the "last frame". This is the signal extension or the time warp effect.

In S109 therefore, the waveform extension is extracted from the position identified by k* and overlap-added to the last frame using complementary windows of appropriate length. The waveform extension is over-lap added using smooth "half" windows in the overlap area. Finally the end of the extension is smoothed, using the original overlap-add window to prepare for the next frame.

Speech intelligibility in reverberant environments decreases with an increase in the reverberation time. This effect is attributed primarily to late reverberation, which can be modelled statistically and without knowledge of the exact hall geometry and positions of the speaker and the listener. The system described above uses a low-complexity speech modification framework for mitigating the effect of late reverberation on intelligibility. Distortion in the speech power dynamics, caused by late reverberation, triggers multi-modal modification comprising adaptive gain control and local time warping. Estimates of the late reverberation power allow for context-aware adaptation of the modification depth.

The system is adaptive to the environment, and provides multi-modal, i.e. in gain control and local time scale modification for a wide operation range. The system uses a distortion criterion. The closed-form minimizer of the distortion criterion is parameterized in terms of a continuous measure of frame importance, for more efficient use of signal power. The system operates with low delay and complexity, which allows it to address a wide range of applications. The modularity of the framework facilitates incremental sophistication of individual components.

Figure 8:
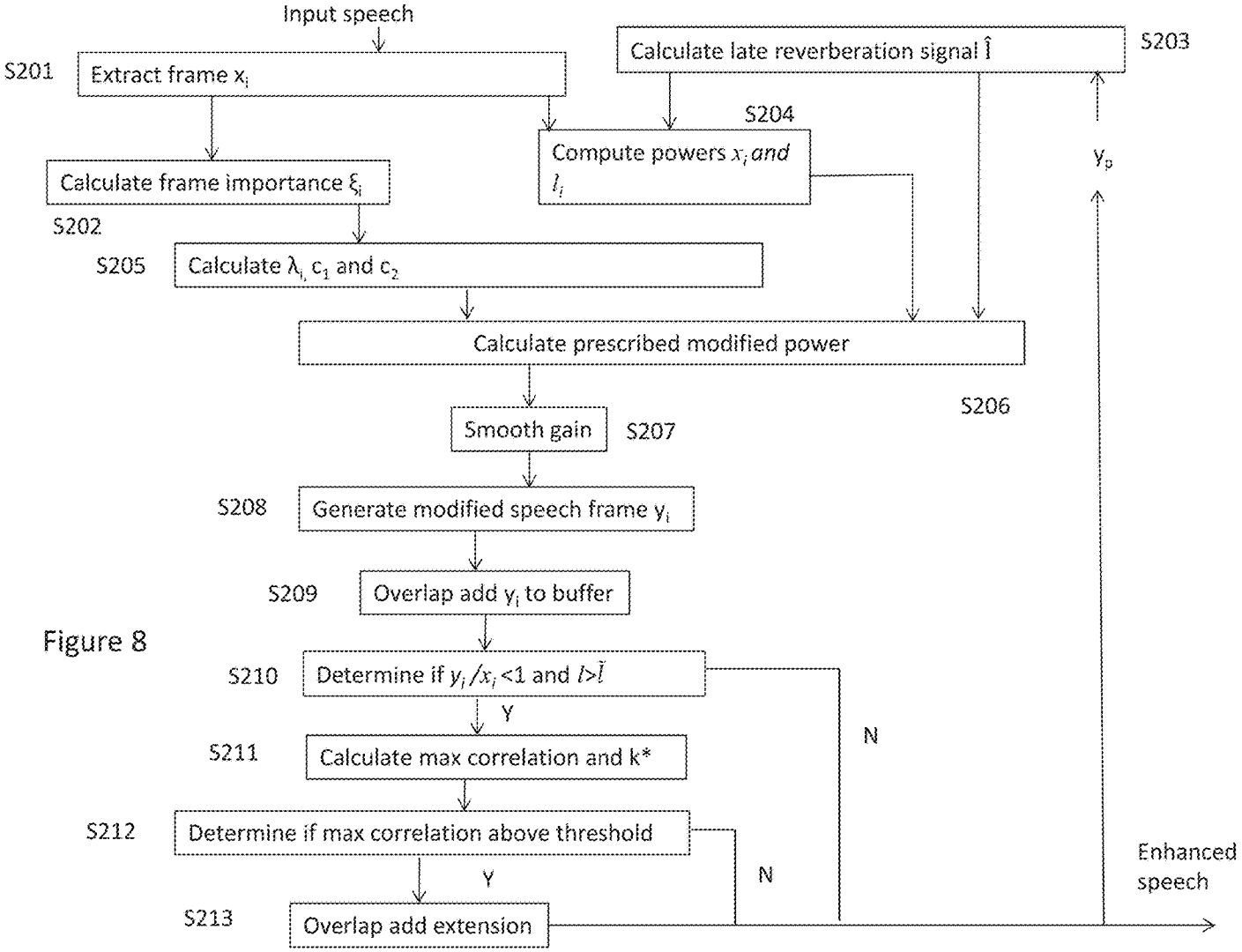
FIG. 8 is a flow diagram showing a method of enhancing speech in accordance with an embodiment.

FIG. 8 is a schematic illustration of the processing steps provided by program 5 in accordance with an embodiment, in which speech received from a speech input 15 is converted to enhanced speech to be output by an enhanced speech output 17.

Step S201 is "Extract frame $x_i$". This corresponds to step S101 shown in the framework in FIG. 2. This step comprises extracting frames from the speech signal x received from the speech input 15. Frames $x_i$ are output from the step S201.

In one embodiment, the duration of the frame is between 10 and 32 ms. For these frame durations, the signal can be considered stationary. In one embodiment, the duration of the frame is 25 ms.

In one embodiment, the frame overlap is 50%. A 50% frame overlap may reduce discontinuities between adjacent frames due to processing.

Any sampling frequency reasonable for speech signal processing can be used. In an embodiment the sampling frequency may be between 1 and 50 kHz. In an embodiment, the sampling frequency $f_s$=16 kHz. In one embodiment, $f_s$=8 KHz.

Step S202 is "Compute frame importance". This corresponds to step S102 in the framework shown in FIG. 2.

The frame importance is a measure of the dissimilarity of the frame to the previous frame. In one embodiment, the frame importance is given by equation (1) above. The output from step S202 is $\xi_i$, the frame importance of the frame i.

In an embodiment, m contains MFCC orders 1 to 12.

Step S203 is "Calculate late reverberation signal".

In an embodiment, a late reverberation signal is calculated by modelling the contribution of the late reverberation to the reverbed signal frame. In one embodiment, the late reverberation can be modelled accurately to reproduce closely the acoustics of a particular hall. In alternative embodiments, simpler models that approximate the masking power due to late reverberation can be used. Statistical models can be used to produce the late reverberation signal. In an embodiment, the Velvet Noise model can be used to model the contribution due to late reverberation. Any model that provides a late reverberation power estimate may be used.

In one embodiment, the late reverberation signal $\hat{l}$ is calculated from equation (7) above. A sample-based late reverberation signal $\hat{l}$ is computed. For a frame i, the value of $\hat{l}[k]$ for each value of k is determined, resulting in a set of values $\hat{l}$, where each value corresponds to a value of k for the frame. An approximation to the masking signal $\hat{l}$, which is the late reverberation, for the duration of the target frame is thus computed from equation (7) above.

This step corresponds to step S103 in the framework shown in FIG. 2. The parameters $T_d$, $RT_{60}$, $t_l$ and $f_s$ may be determined in a pre-deployment stage and stored in the storage 7.

The reverberation time for the intended acoustic environment may be measured, and this measured value is used as the value of $RT_{60}$. Alternatively, an estimated value based on previous studies of similar environments is used. Alternatively, the reverberation time can be derived from a model, for example, if the dimensions and the surface reflection coefficients are known.

In one embodiment, $t_l$=90 ms. In one embodiment, $t_l$=50 ms. In one embodiment, $t_l$ is extracted from a model RIR based on knowledge of the intended acoustic environment. Alternatively, $t_l$ is extracted from the measured RIR. Alternatively, an estimated value based on previous studies of similar environments is used.

Step S204 is compute powers. In an embodiment, this corresponds to step S104 in FIG. 2.

In one embodiment, the input signal frame power $x_i$ and late reverberation frame power $l_i$ are calculated from the input signal $x_i$ and $\hat{l}_i$, output from step S203. The late reverberation frame power $l_i$ is thus calculated from a model of the contribution of the late reverberation to the reverbed speech frame.

In an alternative embodiment, the input signal band powers and the late reverberation band powers are calculated from the input signal $x_i$ and $\hat{l}_i$, output from step S203. In other words the power in each of two or more frequency bands is calculated from the input signal $x_i$ and $\hat{l}_i$, output from step S203. These may be calculated by transforming the frame of the speech received from the speech input and the late reverberation signal into the frequency domain, for example using a discrete Fourier transform. Alternatively, the calculation of the power in each frequency band may be performed in the time domain using a filter-bank.

In an embodiment, the bands are linearly spaced on a MEL scale. In an embodiment, the bands are non-overlapping. In an embodiment, there are 10 frequency bands.

The bands of the input speech frame are then ordered in order of descending power and the bands corresponding to a predetermined fraction of the total frame power in descending order are then determined. The frame power of the late reverberation signal is then determined as the sum of the powers in the bands determined for the corresponding input speech frame. The frame power of the late reverberation signal is thus calculated by summing the band powers of the bands determined from the input speech frame.

In this embodiment, the late reverberation frame power is computed from certain spectral regions only. The spectral regions are determined for each frame by determining the spectral regions of the input speech frame corresponding to the highest powers, for example, the highest power spectral regions corresponding to a predetermined fraction of the frame power. The input signal full band power $x_i$ can be calculated by summing the band powers.

In an embodiment, a prescribed frame power $y_i$ is then calculated from a function of the input signal frame power $x_i$, the measure of the frame importance and the late reverberation frame power $l_i$. The function is configured to decrease the ratio of the prescribed frame power to the power of the extracted input speech frame as the late reverberation frame power $l_i$ increases above a critical value, $\tilde{l}$.

In an embodiment, a prescribed frame power is calculated that minimizes a distortion measure subject to a penalty term, T, wherein T is a function of l, the ratio of the prescribed frame power to the power of the extracted frame, and a multiplier λ, wherein the function is a non-linear function of l configured to increase with l faster than the distortion measure when the late reverberant power is greater than the critical late reverberation power, and wherein λ is parameterised in terms of the frame importance.

The distortion measure may be the first term under the integral in (8) for example. The penalty term is a penalty on power gain. In an embodiment, the penalty term is that given in (9), where w>1. In one embodiment, w=2.

Step S205 comprises the steps of "Calculate λ, $c_1$ and $c_2$" The value of λ for each frame is calculated from:

$$\lambda=\max(\lambda_{v_\xi},\tilde{\lambda}) \text{ for } l\leq\tilde{l}$$

$$\lambda=\lambda_{\bar{v}} \text{ for } l>\tilde{l} \tag{37}$$

where an expression for $\tilde{\lambda}$ is given in (18), a value for $\tilde{l}$ is calculated from the value of $\tilde{\lambda}$, an expression for $\lambda_{v_\xi}$ is given in (21) and expression for $\lambda_{\bar{v}}$ is given in (25).

Values for β, α, ψ and ς are stored in the storage 7. In one embodiment, ς=0.9. In one embodiment, ς=0.001. Values for s, which may be required to calculate λ are also stored in the storage 7. In an embodiment, s is between 1 and 50. In an embodiment, s=15. In an embodiment, s=28. In an embodiment the slopes, s, can be different for the regime in which the MBP is increasing, corresponding to $l\leq\tilde{l}$, and the regime in which the MBP is decreasing, corresponding to for $l>\tilde{l}$.

$\lambda_{v_\xi}$ depends on the frame importance. $\lambda_{\bar{v}}$ also depends on the frame importance through $\lambda_{v_\xi}$.

Once the value of λ has been calculated for the frame, values for $c_1$ and $c_2$ are calculated using equations (14) and (15).

In step S206, the prescribed frame power $y_i$ is calculated, from the values of $x_i$, $l_i$, b, $\lambda_i$ $c_1$ and $c_2$. In an embodiment, the prescribed frame power that minimizes the distortion measure subject to the penalty term is calculated from:

$$y = c_1x + c_2x^b + \frac{l}{2b}(l^{w-1}\lambda - 2b) \tag{36}$$

where b is a constant and w>1. In one embodiment, w=2. A value for b is stored in the storage 7. In an embodiment, b is determined from the Pareto model of training data and may be roughly 0.0981 for example in the full band/single band scenario.

This corresponds to step S105 in the framework in FIG. 2 above.

A modification is calculated using the prescribed frame power and applied to the frame of the speech $x_i$ received from the speech input.

In an embodiment, the modification applied to the frame of the speech $x_i$ received from the speech input is $\sqrt{yi/xi}$.

In an embodiment, smoothing is applied to the modification. This is step S207. The smoothed signal gain may be calculated from (29). Values for U and D may be stored in the storage 7. In an embodiment, U=1.05 and D=0.95. In another embodiment, U=1.3 and D=0.4. In another embodiment, U=1.15 and D=0.15.

The modified speech frame $y_i$ is generated by applying the modification in step S208. In an embodiment, the modification is applied by modifying the signal spectrum, using the signal gain or the smoothed signal gain.

In an embodiment, the modified speech frame is then overlap-added to the enhanced speech signal generated for previous frames in step S209, and the resultant signal is output from output 17.

Alternatively, a time modification is included before the signal is output. In an embodiment, the time modification is a time warp.

In step S210, it is determined whether the smoothed signal gain is less than 1 and whether l is greater than $\tilde{l}$.

If one of these conditions is not fulfilled, no time scale modification is applied.

If both of these conditions are fulfilled, the maximum correlation and corresponding value of time lag, k* are calculated in step S211. The correlation value for each time lag k is calculated from (33). The maximum correlation value and the corresponding lag, k* are then determined, according to (34).

At this point, it is determined whether the maximum correlation value is above a threshold value, in step S212. In an embodiment, the threshold is a constant value. In another embodiment, the threshold is determined from (35). In an embodiment, $\Omega=2/3$.

If the maximum correlation value is not above the threshold, no time modification is applied. If the maximum correlation is above the threshold, the next step is "Overlap add extension". In this step, the waveform extension is extracted from the position identified by k* and overlap-added to the last frame.

In an embodiment, the number of consecutive time-warps is limited to two.

The enhanced speech is then output.

Figure 9:
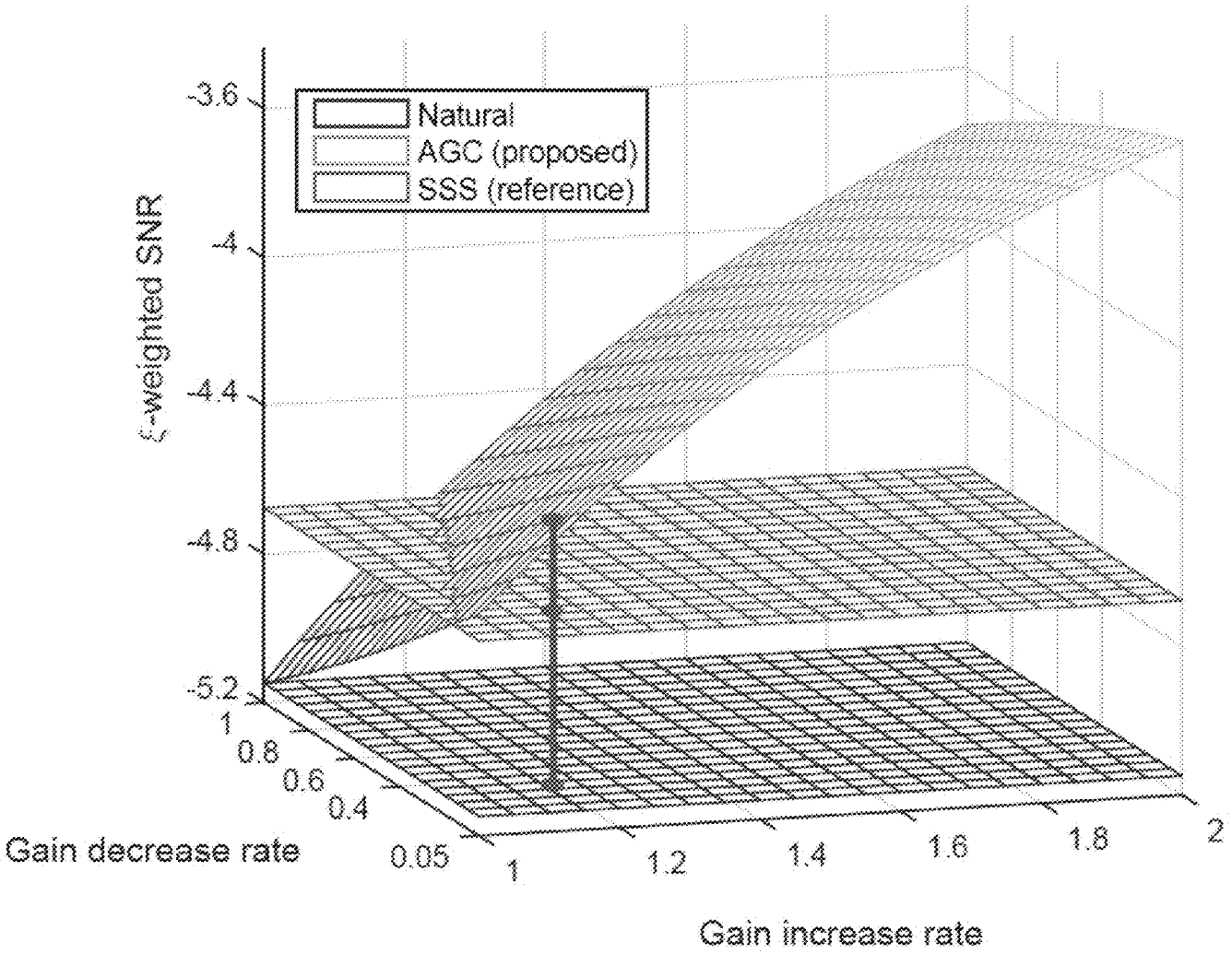
FIG. 9 shows the frame importance-weighted SNR in the domain of the two parameters U and D.

FIG. 9 shows the frame importance-weighted SNR averaged over 56 sentences in the domain of the two parameters U and D of the enhanced system according to an embodiment, labelled Adaptive gain control (AGC) and natural speech. The SNR is defined here as the direct-path-to-late-reverberation ratio. The two parameters U and D are described in relation to equation (32) above. They are related to the maximum signal gain increase rate $U^{\Phi}\sqrt{g_i}$ and signal gain decrease rate D, which reflect how quickly the smoothed signal gain follows the locally optimal signal gain, calculated from the prescribed frame power determined from the distortion criterion.

In general, the power of the input speech signal is reduced in regions with high redundancy. The masking of transient regions by late reverberation is in turn decreased. This can be measured using the frame importance-weighted SNR. The frame-based SNR is weighted by the frame-importance (iwSNR). The performance of the system is identical to natural speech when the signal gain modification rates are fixed to unity, and quickly increases as these become more aggressive. The figure shown is for the case of $RT_{60}$=1:8 s.

A subjective test with five native UK English listeners was performed. Five people were sufficient to measure significant ($p<0.05$) intelligibility improvement over natural speech. The signal gain modification parameter settings are indicated by the position of the red ellipse in FIG. 9. The absolute smoothing constraints in equations (29) and (32) were used.

| | Natural speech | AGC system |
|---|---|---|
| Subject i | 0.68 | 0.77 |
| Subject ii | 0.61 | 0.62 |
| Subject iii | 0.47 | 0.54 |
| Subject iv | 0.64 | 0.78 |
| Subject v | 0.78 | 0.81 |
| Average | 0.64 | 0.71 |

Combining AGC with time warping (TW) allows for a further increase of iwSNR.

Figure 10:
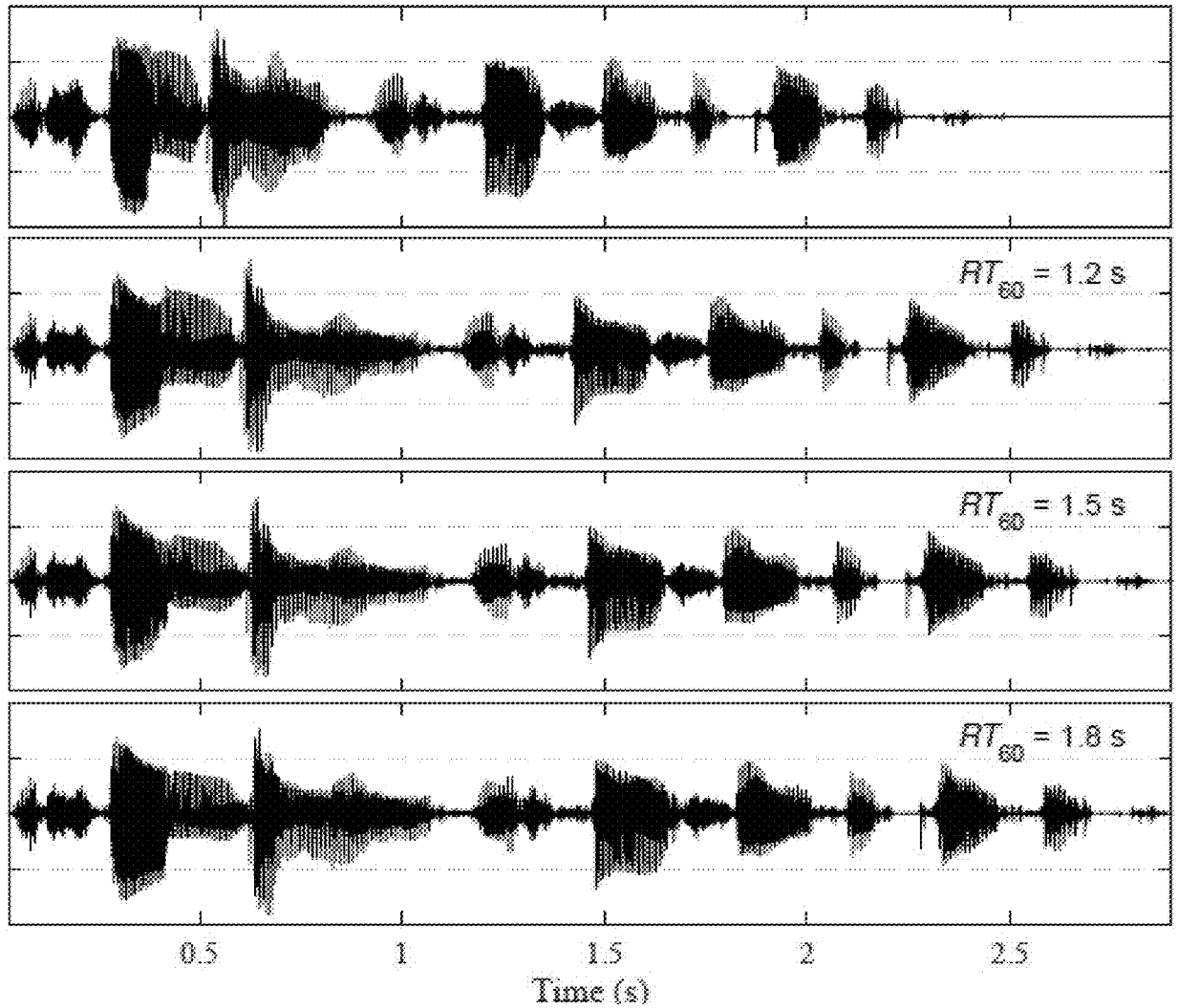
FIG. 10 shows the signal waveforms for natural speech, corresponding to the top waveform; and enhanced speech, corresponding to the bottom three waveforms.

FIG. 10 shows the signal waveforms for natural speech, corresponding to the top waveform; and AGCTW modified speech, corresponding to the bottom three waveforms. The first AGCTW waveform corresponds to $RT_{60}$=1.2 s, the second to $RT_{60}$=1.5 s and the third to $RT_{60}$=1.8 s. These values represent moderate-to-severe reverberation.

Adaptive gain control and time warping (AGCTW) is used to denote the system described in relation to FIGS. 2 and 8 above, in which both modification producing a modified frame power and time scale modification are applied to the input speech.

The AGCTW modified speech was modified based on a prescribed output power, which was calculated from a function of input power, late reverberation power and frame importance. The function minimizes a tailored distortion criterion from the domain of power dynamics subject to a penalty term. Under reverberation-induced suppression, a time warp prevents loss of information. Signal gain smoothing for enhanced perceptual impact is also applied. The method of modification is described in relation to FIG. 8 above.

The parameter settings used are as follows. The training data used to fit $f_x(x|b)$, and determine $\alpha$ and $\beta$ was a British English recording comprising 720 sentences. The frame duration was 25 ms, and the frame overlap was 50%. $t_l$ was 50 ms and $\varepsilon$ was 0:001. The search intervals $K_1$ and $K_2$ were 0:003 $f_s$ and 0:02 $f_s$ respectively. The sampling frequency was $f_s$ 16 kHz and m contained MFCC orders 1 to 12. The pulse density in i was 2000 $s^{-1}$. J, the number of frequency bands, was set to 10, $\Omega$ was 2/3 and $\psi$ was $\beta^4$. The values for S, U and D were 15, 1:05 and 0:95 respectively. The relative constraints given in equations (29a) and (32a) were used.

Reverberation was simulated using a model RIR obtained with a source-image method. The hall dimensions were fixed to 20 m×30 m×8 m. The speaker and listener locations used for RIR generation were {10 m, 5 m, 3 m} and {10 m, 25 m, 1.8 m} respectively. The propagation delay and attenuation were normalized to the direct sound. Effectively, the direct sound is equivalent to the sound output from the speaker.

AGCTW decreased the power by 31%, 30% and 29% respectively, averaged over all data.

Under reverberation, aggressive modifications may be detrimental, thus slower tracking of the locally optimal power gain produces smoother signals and enhances intelligibility. There is a gradual elongation of the modified waveforms with the increase in reverberation time, and smoothness is also achieved with respect to the extent of time warping.

The signal duration gradually increases with $RT_{60}$ up until saturation, to accommodate higher late reverberation power. Limiting the number of consecutive time-warps to two reduces over-periodicity. AGCTW has a low algorithmic delay due to the causality of the importance estimator. The method complexity is low, with late reverberation waveform computation as the most demanding task.

In an embodiment, real-time processing is achieved by accounting for the sparsity of $\tilde{h}$ from eq. (2). The model RIR is long, in order to reflect the reverberation time, so the convolution becomes slow. In practice, the pulse locations in the model for the later reverberation part of the RIR are known, so this can be used to reduce the number of operations.

The signal modification framework described in relation to FIG. 8 was validated with a listening test. Eight native normal-hearing English listeners were recruited for the purpose. The material comprised thirteen sets, with one set used for volume adjustment. A total of 120 sentences from the Harvard sentence database were presented to each listener following an established test protocol, with the difference that a single condition was observed by each subject.

Figure 11:
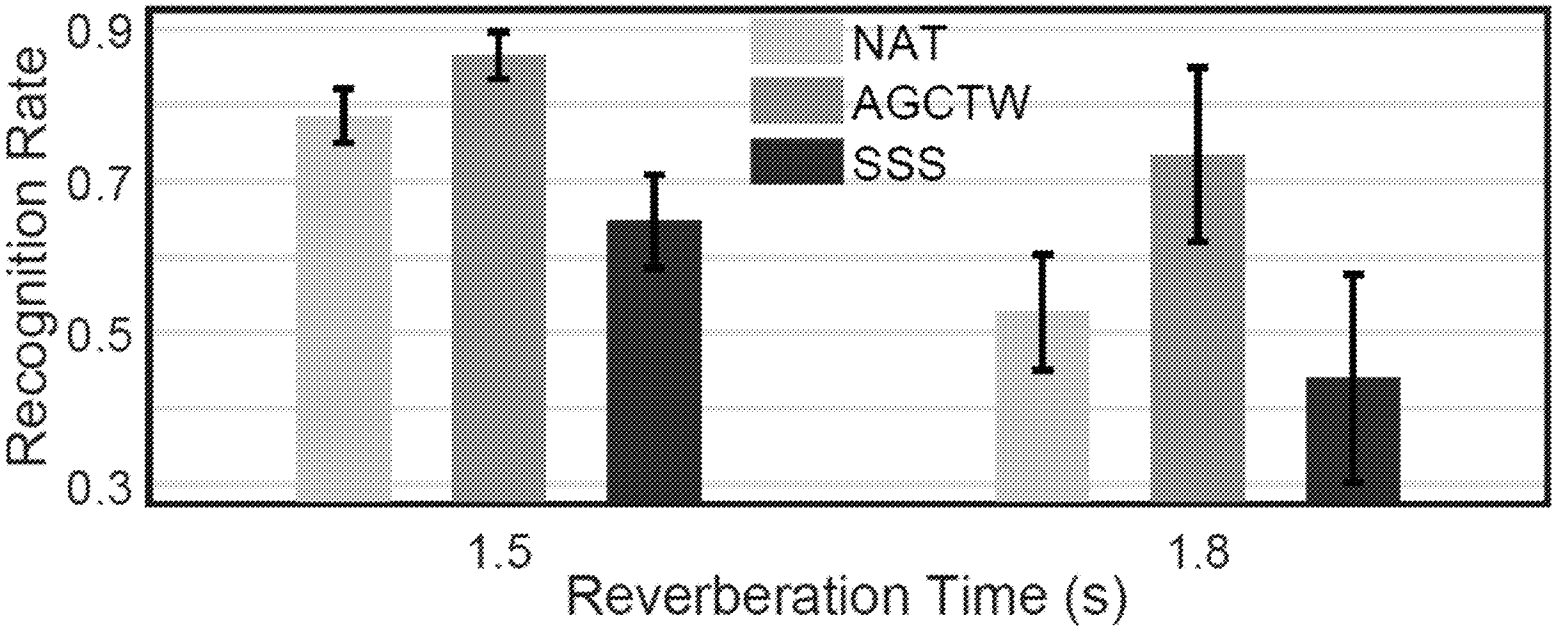
FIG. 11 shows recognition rate results for natural speech and enhanced speech.

Utterance power was equalized to facilitate comparison. The material was presented diotically, in a silent room, using a pair of Audio-technica ATH-M50× headphones. The results in FIG. 11 show that AGCTW outperforms significantly natural speech. Four listeners sufficed to achieve a significant level of $p<0.05$ (t-test) in each condition. AGCTW's intelligibility gain sees an average cost of 21% duration increase at $RT_{60}$=1:5 s, and 23% at $RT_{60}$=1:8 S.

Figure 12:
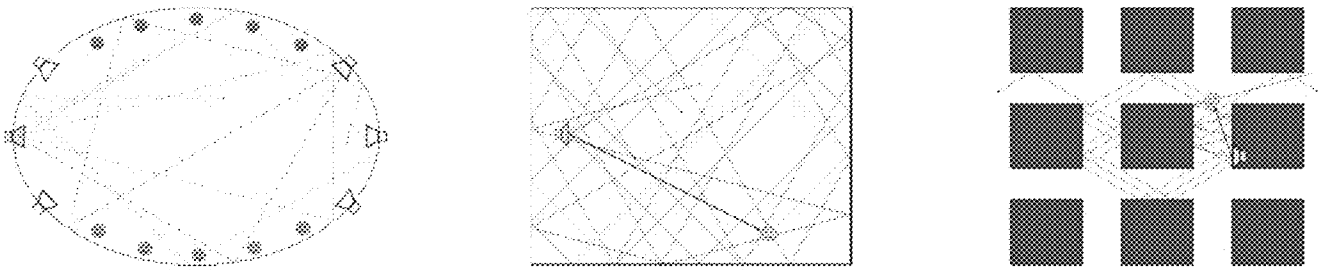
FIG. 12 shows a schematic illustration of reverberation in different acoustic environments.

FIG. 12 shows a schematic illustration of reverberation in different acoustic environments. The figures show examples of the paths travelled by speech signals generated at the speaker, for an oval hall, a rectangular hall, and an environment with obstacles.

Sufficiently high reverberation reduces speech intelligibility. Degradation of intelligibility can be encountered in large enclosed environments for example. It can affect public announcement systems and teleconferencing. Degradation of intelligibility is a more severe problem for the hard of hearing population.

Reverberation reduces modulation in the speech signal. The resulting smearing is seen as the source of intelligibility degradation.

Speech signal modification provides a platform for efficient and effective mitigation of the intelligibility loss.

The framework in FIG. 2 is a framework for multi-modal speech modification, which introduces context awareness through a distortion criterion. Both signal-side, i.e. frame redundancy evaluation, and environment-side, i.e. late reverberation power, aspects are represented by context awareness. Multi-modal modification maintains high intelligibility in severe reverberation conditions.

The modification is characterized by a low processing delay and a low complexity. In an embodiment, the most computationally costly operations are the search for the optimal lag k*, the MFCC computation in the frame redundancy estimator and the convolution with $\tilde{h}$ in equation (2).

The modification can significantly improve intelligibility in reverberant environments.

In some embodiments, the system implements context awareness in the form of adaptation to reverberation time $RT_{60}$ and local speech signal redundancy. The system allows modification optimality as a result of using an auditory-domain distortion criterion in determining the depth of the speech modification. The system allows simultaneous and coherent modification along different signal dimensions allowing for reduced processing artefacts.

In some embodiments, the system is based on a general theoretical framework that facilitates method analysis.

In some embodiments, the system can be used for public announcements in enclosed spaces such as train stations, airports, lecture halls, tunnels and covered stadiums. Alternatively, the system can be used for teleconferencing or disaster prevention systems.

As described above, FIG. 2 shows a general framework for improving speech intelligibility in reverberant environments through speech modification. Simultaneous modification of the frame-specific power and the local time scale provide a modified speech signal with low level of artefacts and higher intelligibility under reverberation.

The framework provides a unified and general framework that combines context-awareness with multi-modal modifications. These support good performance in a wide range of conditions. The information content, or importance, of a speech segment is measured, and this information is used when optimizing the modification.

Speech intelligibility in reverberant environments decreases due to overlap-masking caused by late reverberation. Similar to additive noise, stronger reverberation induces a higher degradation. For reverberation, speech modification at a given time affects reverberation at a later time. Taking into account the specifics of the problem, a tailored distortion criterion from the domain of power dynamics is minimized to determine the optimal output power. The closed form solution depends on the late reverberation power and is parametrized in terms of the redundancy in the speech signal enabling context-aware modification.

In some embodiments, power suppression due to excessive reverberation is assisted by a time warp to mitigate possible loss of intelligibility cues. Multi-modal modifications offer an extended operating range and reduction in processing distortions. The method results in a significant improvement over natural speech in moderate-to-severe reverberation conditions.

In some embodiments, overlapping frames are extracted from the input speech signal and labelled according to their importance. A model of late reverberation predicts the concurrent late reverberation power. The optimal full-band output power is computed from the input power, late reverberation power and frame importance. Frame-based estimates are used in place of instantaneous power. The output power is smoothed to prevent distortion. The modified signal frame is synthesized and added to the buffer. In case of power reduction, the time is warped, conditional on the late reverberant power.

In some embodiments, enhancement of speech intelligibility in reverberant environments is achieved by jointly modifying spectral and temporal signal characteristics. Adapting the degree of modification to external (acoustic properties of the environment) and internal (local signal redundancy) factors offers scalability and leads to a significant intelligibility gain with low level of processing artefacts.

The speech intelligibility enhancing systems described above achieve significant speech intelligibility improvement in reverberant environments. The speech modification is performed based on a distortion criterion, which allows good adaptation to the acoustic environment. The speech intelligibility enhancing systems have good generalization capabilities and performance. The operating range extends to environments with heavy reverberation. In some embodiments, the speech intelligibility enhancing systems utilise simultaneous and coherent gain control and time warp. In some embodiments, the speech intelligibility enhancing systems provide a parametric perceptually-motivated approach to smoothing the locally-optimal gain.

In some embodiments, speech intelligibility enhancing systems use multi-band processing in a part of the processing chain.

In some embodiments, the notion of information content of a segment is approximated by the frame importance. Remaining in a deterministic setting, the adopted parameter space is capable of generalising the information content with a high resolution.

In some embodiments, late reverberation is modelled as noise and a distortion criterion is optimised. A distortion criterion targeting reverberation may be used.

In some embodiments, time warping occurs during signal suppression. The extent of time warping adapts to both the local speech properties and the acoustic environment.

Due to its diffuse nature, late reverberation can be modelled statistically. At a particular instant late reverberation can be treated as additive noise, uncorrelated with the signal due to differences in propagation time. Boosting the signal creates more reverberation "noise", whereas slowing down the signal reduces the overlap-masking, but also reduces the information transfer rate. In some embodiments, a combination of adaptive gain control and time warping during power suppression is provided. This may be effective in particular for environments with reverberation time below two seconds for example.

In some embodiments, the speech intelligibility enhancing systems are adaptive to the environment and provide multi-modal, i.e. in time warp and adaptive gain control, modification. This extends the operation range. Use of high-resolution frame-importance may lead to more efficient use of signal power. Parametric smoothing of the locally-optimal gain may be included, to allow for further tuning and processing constraints.

In some embodiments, the speech intelligibility enhancing systems provide low delay and complexity and allow for addressing a wide range of applications. Furthermore, the framework modularity facilitates incremental sophistication of individual components.

In some embodiments, apart from a short processing delay, the system is causal and therefore suitable for on-line applications.

While certain embodiments have been described, these embodiments have been presented by way of example only, and are not intended to limit the scope of the inventions. Indeed the novel methods and apparatus described herein may be embodied in a variety of other forms; furthermore, various omissions, substitutions and changes in the form of methods and apparatus described herein may be made without departing from the spirit of the inventions. The accompanying claims and their equivalents are intended to cover such forms of modifications as would fall within the scope and spirit of the inventions.

The invention claimed is:

1. A speech intelligibility enhancing system for enhancing speech, the system comprising:

a speech input for receiving speech to be enhanced;

an enhanced speech output to output the enhanced speech; and a processor configured to convert speech received from the speech input to enhanced speech and to output the enhanced speech at the enhanced speech output, the processor being configured to:

i) extract a frame of the speech received from the speech input;

ii) calculate a measure of the frame importance;

iii) estimate a contribution due to late reverberation to the frame power of the speech when reverbed;

iv) calculate a prescribed frame power, the prescribed frame power being a function of the power of the extracted frame, the measure of the frame importance and the contribution due to late reverberation, the function being configured to decrease the ratio of the prescribed frame power to the power of the extracted frame as the contribution due to late reverberation increases above a critical value, Z; and v) apply a modification to the frame of the speech received from the speech input producing a modified frame power, wherein the modification is calculated using the prescribed frame power.

2. The system according to claim 1, wherein the measure of the frame importance is a measure of the dissimilarity of the mel cepstrum of the frame to that of the previous frame.

3. The system according to claim 1, wherein the contribution due to late reverberation is estimated by modelling the impulse response of the environment as a pulse train that is amplitude-modulated with a decaying function.

4. The system according to claim 1, wherein the prescribed frame power is calculated from:

$$y = c_1 x + c_2 x^b + \frac{l}{2b}(l^{w-1}\lambda - 2b)$$

where y is the prescribed frame power, x is the frame power of the extracted frame, l is the contribution due to late reverberation, λ is a multiplier, w is greater than 1, $c_1$ and $c_2$ are determined from a first and second boundary condition and b is a constant.

5. The system according to claim 4, wherein the first boundary condition is:

$$y(\alpha)=\alpha$$

where α is the minimum value of the frame power obtained from sample speech data and wherein the second boundary condition is:

$$y'(\psi)=\zeta^{l}$$

where $\zeta \in (0,1)$ and $\psi >> \beta$, where β is the maximum value of the frame power obtained from sample speech data.

6. The system according to claim 5, wherein 2 is calculated from:

$$\lambda=\max(\lambda_1,\tilde{\lambda})\ l\leq\tilde{l}$$

$$\lambda=\lambda_2\ l>\tilde{l}$$

wherein $\tilde{\lambda}$ is a constant determined such that the crossing point of the prescribed frame power as a function of x and the function y=x for $l=\tilde{l}$ and $\lambda=\tilde{\lambda}$ is β, and such that this is the maximum value of the crossing point for all values of l, and $\lambda_1$ and $\lambda_2$ are calculated from a function of the frame importance.

7. The system according to claim 6, wherein $\lambda_1$ and $\lambda_2$ are calculated such that the crossing point of the prescribed frame power as a function of x and the function y=x depends on the frame importance.

8. The system according to claim 1, wherein iii) comprises:

(a) calculating the fraction of the frame power of the extracted frame in each of two or more frequency bands;

(b) determining the frequency bands of the extracted frame corresponding to the highest power bands corresponding to a predetermined fraction of the extracted frame power;

(c) generating an approximation to the late reverberation signal;

(d) calculating the fraction of the power of the late reverberation signal in each of the frequency bands determined in (b);

wherein the contribution due to late reverberation to the frame power of the speech when reverbed is estimated as the sum of the powers of the late reverberation signal in each of the frequency bands calculated in (d).

9. The system according to claim 1, wherein the rate of change of the modification is limited such that:

$$D<\ddot{g}_i\leq U^{\Phi}\sqrt{g_i}$$

where i is the frame index, $\ddot{g}_i$ is the square root of the ratio of the modified frame power to the power of the extracted frame, $g_i$ is the square root of the ratio of the prescribed frame power to the power of the extracted frame, and $\phi$, U and D are constants.

10. The system according to claim 9, wherein the modification applied to the frame of the speech received from the speech input is calculated from:

$$\ddot{g}_i = \min(u_i, g_i) \text{ if } g_i > 1$$

$$\ddot{g}_i = \max(d_i, g_i) \text{ if } g_i \leq 1$$

where:

$$u_i = \frac{1 - e^{-s\xi_i}}{1 + e^{-s\xi_i}}\left(U^{\frac{\phi}{\sqrt{g_i}}} - 1\right) + 1$$

$$d_i = \frac{1 - e^{-s\xi_i}}{1 + e^{-s\xi_i}}(1 - D) + D$$

where s is a constant, $\phi$ is a constant, and $\xi_i$ is the frame importance.

11. The system according to claim 10, wherein the value of $\phi$ for a frame is selected from two or more values, based on some characteristic of the frame.

12. The system according to claim 1, wherein step i) comprises:

extracting overlapping frames of the speech received from the speech input;

and wherein the processor is further configured to:

vi) apply a local time scale modification if the ratio of the modified frame power to the power of the extracted frame is less than 1 and l is greater than $\tilde{l}$, wherein $\tilde{l}$ is the critical value of the contribution due to late reverberation.

13. The system according to claim 12, wherein step vi) comprises:

overlap adding the modified frame output from step v) to the modified speech signal comprising the modified previous frames, to output a new modified speech signal; and wherein applying a time scale modification comprises:

calculating the correlation between a last segment of the new modified speech signal and each of a plurality of target segments of the new modified speech signal, wherein the target segments correspond to a range of earlier segments of the new modified speech signal;

determining the target segment corresponding to the highest correlation value;

if the correlation value of the target segment is greater than a threshold value;

replicating the section of the new modified speech signal from the target segment to the end of the new modified speech signal;

overlap-adding this replicated section to the last segment of the new modified speech signal.

14. The system according to claim 13, wherein the threshold value is the correlation value where the target segment is the last segment, multiplied by $\Omega$, where $\Omega \epsilon (0,1)$.

15. A speech intelligibility enhancing system for enhancing speech, the system comprising:

a speech input for receiving speech to be enhanced;

an enhanced speech output to output the enhanced speech; and a processor configured to convert speech received from the speech input to enhanced speech and to output the enhanced speech at the enhanced speech output, the processor being configured to:

i) extract a frame of the speech received from the speech input;

ii) calculate a measure of the frame importance;

iii) estimate a contribution due to late reverberation to the frame power of the speech when reverbed, Z;

iv) calculate a prescribed frame power that minimizes a distortion measure subject to a penalty term, T, wherein T is a function of (a) the contribution Z due to late reverberation, (b) the ratio of the prescribed frame power to the power of the extracted frame, and (c) a multiplier X, wherein the function is a non-linear function of Z configured to increase with Z faster than the distortion measure above a critical value Z; and v) apply a modification to the frame of the speech received from the speech input producing a modified frame power, wherein the modification is calculated using the prescribed frame power.

16. The system according to claim 15, wherein:

$$T \propto \lambda l^{w} \frac{y}{x}$$

where w is greater than 1, y is the prescribed frame power and x is the frame power of the extracted frame.

17. The system according to claim 16, where w=2.

18. The system according to claim 15, wherein the prescribed frame power is calculated subject to X, being a function of the measure of the frame importance.

19. A method of enhancing speech, the method comprising the steps of:

receiving speech to be enhanced;

extracting a frame of the received speech;

calculating a measure of the frame importance;

estimating a contribution due to late reverberation to the frame power of the speech when reverbed;

calculating a prescribed frame power, the prescribed frame power being a function of the power of the extracted frame, the measure of the frame importance and the contribution due to late reverberation, the function being configured to decrease the ratio of the prescribed frame power to the power of the extracted frame as the contribution to late reverberation increases above a critical value, l; and applying a modification to the frame power of the frame of the speech received from the speech input thereby producing a modified frame of speech, wherein the modification is calculated using the prescribed frame power; and generating and outputting enhanced speech utilizing the modified frame of speech.

20. A non-transitory carrier medium comprising computer readable code configured to cause a computer to perform the method of claim 19.

* * * * *